US010807816B2

(12) United States Patent
Oguchi et al.

(10) Patent No.: US 10,807,816 B2
(45) Date of Patent: Oct. 20, 2020

(54) SHEET CASSETTE

(71) Applicant: FUJITSU COMPONENT LIMITED, Tokyo (JP)

(72) Inventors: Tatsuya Oguchi, Tokyo (JP); Sumio Watanabe, Tokyo (JP); Yukihiro Mori, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 16/210,419

(22) Filed: Dec. 5, 2018

(65) Prior Publication Data

US 2019/0193965 A1 Jun. 27, 2019

(30) Foreign Application Priority Data

Dec. 22, 2017 (JP) ..... 2017-245692

(51) Int. Cl.

| | |
|---|---|
| ***B65H 1/26*** | (2006.01) |
| ***B65H 1/12*** | (2006.01) |
| ***B65H 1/04*** | (2006.01) |
| ***B41J 3/36*** | (2006.01) |

(52) U.S. Cl.

CPC ..... *B65H 1/266* (2013.01); *B41J 3/36* (2013.01); *B65H 1/04* (2013.01); *B65H 1/12* (2013.01); *B65H 2402/42* (2013.01); *B65H 2405/115* (2013.01); *B65H 2407/21* (2013.01)

(58) Field of Classification Search

CPC . B65H 1/266; B65H 1/04; B65H 1/12; B65H 2407/21; B65H 2405/115; B65H 2405/332; G03G 15/6502; G03G 15/6514; B41J 3/36; B41J 13/103; B41J 13/0081

See application file for complete search history.

(56) References Cited

U.S. PATENT DOCUMENTS

| | | | | |
|---|---|---|---|---|
| 4,087,178 | A * | 5/1978 | Pfeifer | B65H 1/04 271/117 |
| 4,363,477 | A * | 12/1982 | Miyashita | B65H 1/266 271/117 |
| 6,121,990 | A * | 9/2000 | Fujiwara | B41J 13/00 347/222 |
| 6,270,271 | B1 * | 8/2001 | Fujiwara | B41J 3/36 400/120.01 |
| 6,539,180 | B1 | 3/2003 | King | |
| 7,267,336 | B2 * | 9/2007 | Kojima | B41J 13/103 271/145 |

(Continued)

FOREIGN PATENT DOCUMENTS

| | | |
|---|---|---|
| EP | 1110886 | 6/2001 |
| EP | 1918116 | 5/2008 |
| JP | 57072543 A * | 5/1982 |

(Continued)

*Primary Examiner* — Luis A Gonzalez

(74) *Attorney, Agent, or Firm* — IPUSA, PLLC

(57) ABSTRACT

A sheet cassette connectable to a printer includes a case, a spring, a cover, and a connecting part. The case stores a recording sheet. The spring is provided on the case. The cover covers the case and the spring and slides relative to the case to expose the spring. The connecting part is attached to the case and is connectable to the printer. The spring is exposed to press a recording sheet placed on the cover toward a position at which the printer is to be located when connected to the sheet cassette.

10 Claims, 38 Drawing Sheets

(56) References Cited

U.S. PATENT DOCUMENTS

| | | | |
|---|---|---|---|
| 2006/0056901 | A1 | 3/2006 | Shiraishi et al. |
| 2008/0024576 | A1 | 1/2008 | Kim |

FOREIGN PATENT DOCUMENTS

| | | | | |
|---|---|---|---|---|
| JP | 61277525 | A | * | 12/1986 |
| JP | 02209326 | A | * | 8/1990 |
| JP | 11288043 | A | * | 10/1999 |
| JP | 11314773 | A | * | 11/1999 |
| JP | 2003-320730 | | | 11/2003 |
| JP | 2004-345819 | | | 12/2004 |
| JP | 2006-159427 | | | 6/2006 |
| KR | 10-2005-0087810 | | | 8/2005 |
| KR | 10-2017-0070645 | | | 6/2017 |

* cited by examiner

SHEET CASSETTE

CROSS-REFERENCE TO RELATED APPLICATION

The present application is based on and claims priority to Japanese patent application No. 2017-245692, filed on Dec. 22, 2017, the entire contents of which are incorporated herein by reference.

BACKGROUND OF THE INVENTION

1. Field of the Invention

The present invention relates to sheet cassettes.

2. Description of the Related Art

Conventional portable printers have a box shape and are relatively large, and are carried in a bag or the like. Portable printers are preferably small, light, and easy to carry. See, for example, Japanese Laid-open Patent Publication Nos. 2006-159427 and 2004-345819.

SUMMARY OF THE INVENTION

According to an aspect of the present invention, a sheet cassette connectable to a printer includes a case, a spring, a cover, and a connecting part. The case stores a recording sheet. The spring is provided on the case. The cover covers the case and the spring and slides relative to the case to expose the spring. The connecting part is attached to the case and is connectable to the printer. The spring is exposed to press a recording sheet placed on the cover toward a position at which the printer is to be located when connected to the sheet cassette.

DESCRIPTION OF THE EMBODIMENTS

Figure 1:
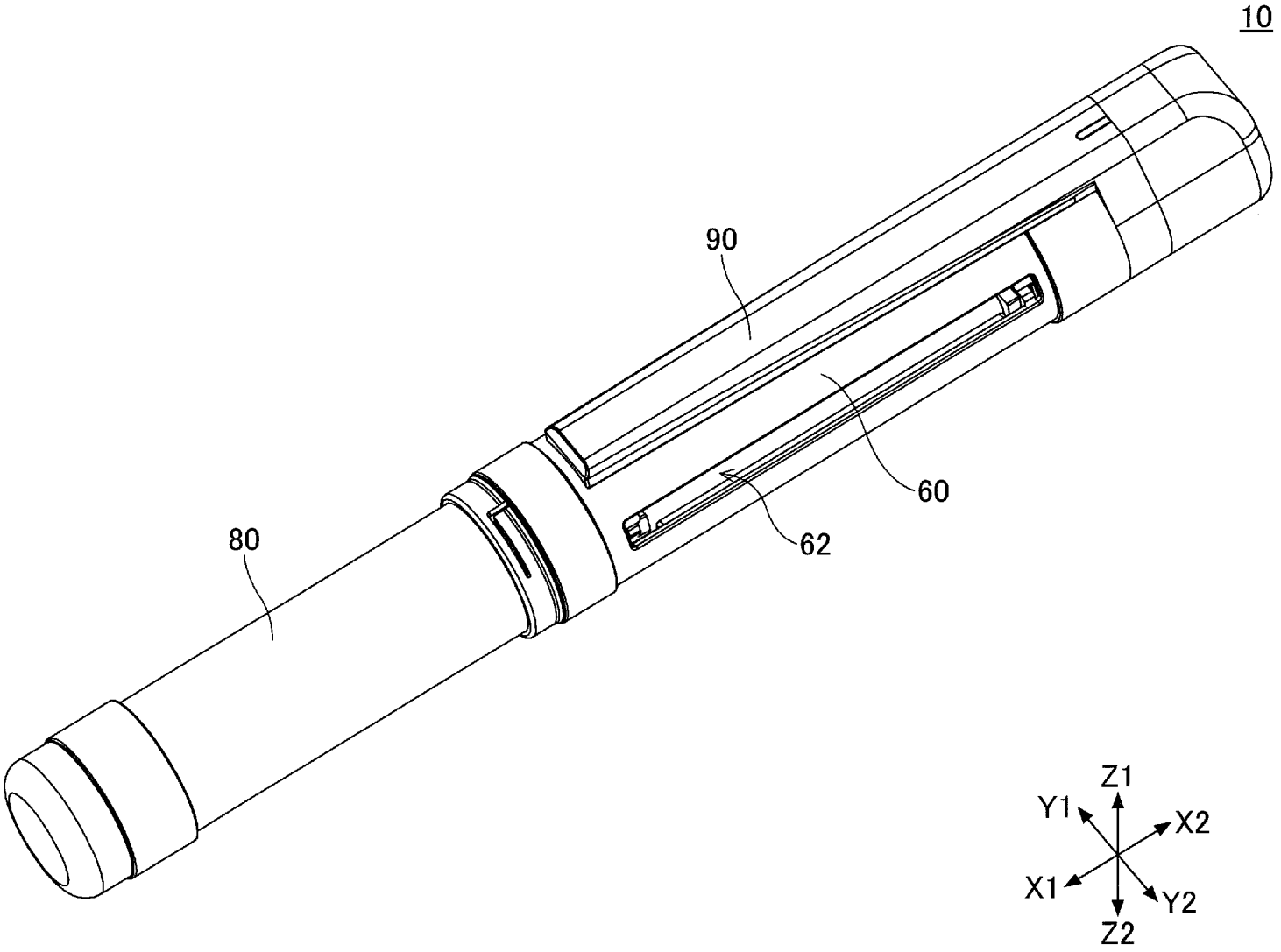
FIGS. 1 and 2 are a perspective view and a cross-sectional view, respectively, of a printer.

To perform printing on a cut sheet, portable printers may require a case for storing recording sheets and a sheet feeder. To make portable printers small, light, and easy to carry, it is preferable to make cases and sheet feeders as well easy to carry accordingly.

Embodiments of the present invention are described with reference to the accompanying drawings. In the following, the same members or the like are referred to using the same reference numeral, and duplicate description thereof is omitted. Furthermore, the embodiment is described using an XYZ coordinate system as defined as illustrated in the drawings. A direction along the X-axis is referred to as "X direction." A direction along the Y-axis is referred to as "Y direction." A direction along the Z-axis is referred to as "Z direction." The X direction, the Y direction, and the Z direction are orthogonal to one another. A plane including the X direction and the Y direction is referred to as "XY plane." A plane including the Y direction and the Z direction is referred to as "YZ plane." A plane including the Z direction and the X direction is referred to as "ZX plane."

Figure 2:
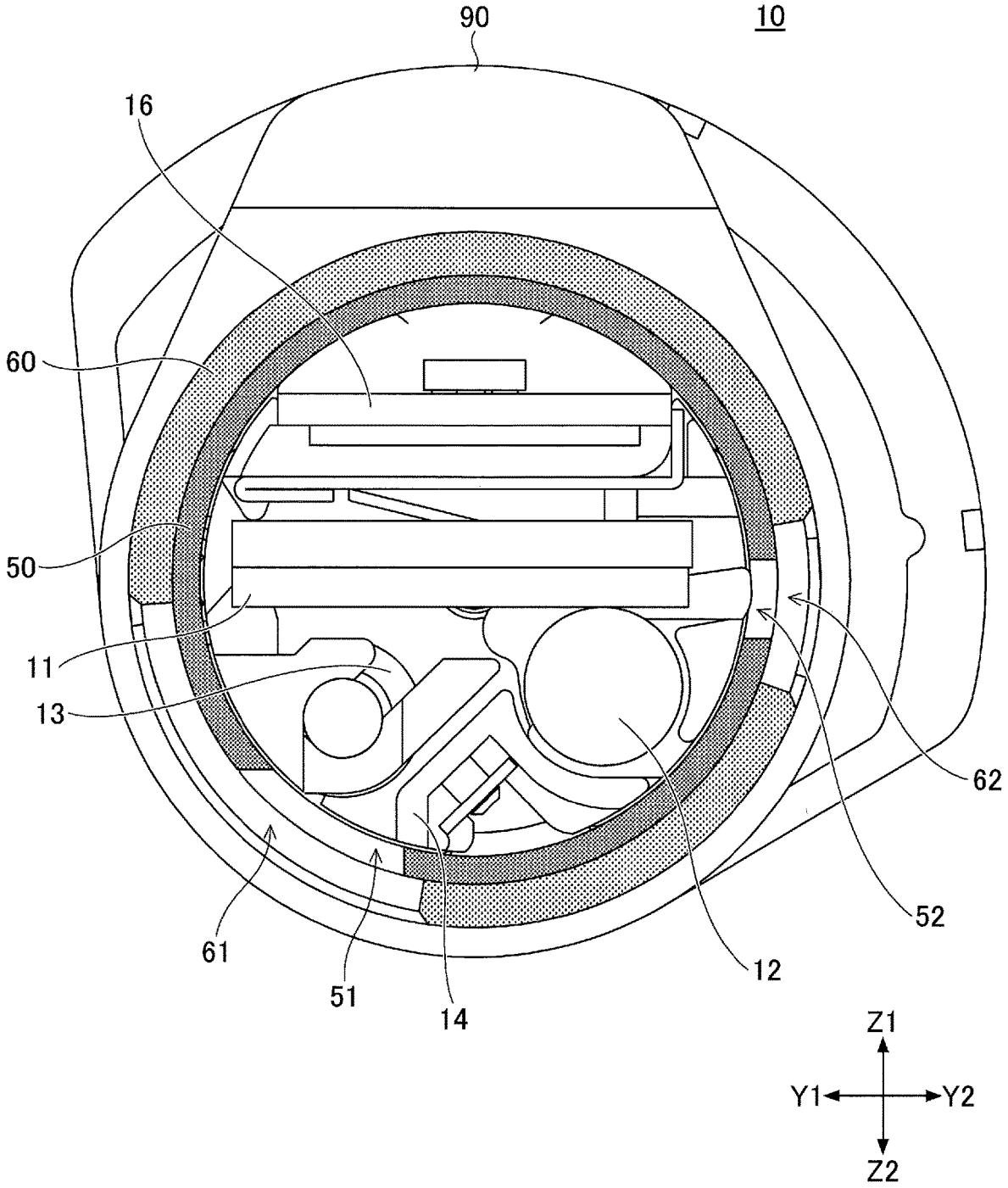
Figure 3:
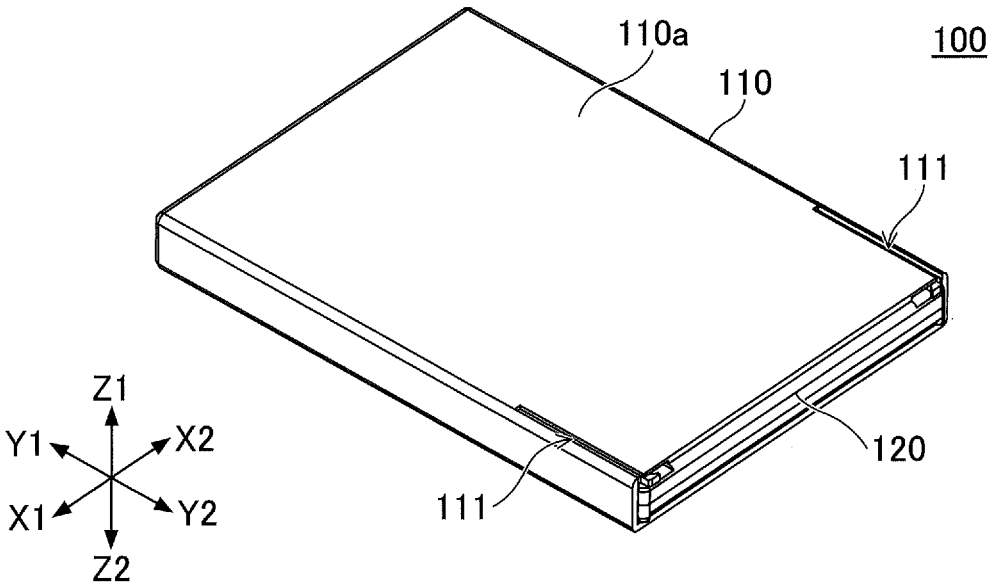
FIGS. 3, 4, 5, 6 and 7 are a top perspective view, a bottom perspective view, a top plan view, a front view and a sectional view, respectively, of a sheet cassette according to a first embodiment.

A portable printer 10 to which a sheet cassette according to an embodiment is attachable is described with reference to FIGS. 1 and 2. The cylindrical printer 10 is also referred to as a pen-type printer. FIGS. 1 and 2 are a perspective view and a cross-sectional view, respectively, of the printer 10. The printer 10 is an Internet of Things (IoT) device including a printing function and a radio communication function.

The printer 10 includes a print head 11 such as a thermal head, a platen roller 12, a feed roller 13, a sheet guide 14, a spring, a control board 16, an inner cover 50, and an outer cover 60. The print head 11 is pressed against the platen roller 12 by the spring. A recording sheet is fed by the feed roller 13 to move into the printer 10 along the sheet guide 14. The recording sheet is conveyed by the platen roller 12 while being held between the print head 11 and the platen roller 12, and is thereafter discharged. An electronic circuit and electronic components that control the printer 10 are mounted on the control board 16.

The cylindrical inner cover 50 is accommodated in the cylindrical outer cover 60. The inner cover 50 includes an insertion opening 51 and a discharge opening 52 that are open along the generatrix of the inner cover 50. The outer cover 60 includes an insertion opening 61 and a discharge opening 62 that are open along the generatrix of the outer cover 60. The outer cover 60 is rotatable relative to the inner cover 50.

When the printer 10 performs printing, the opening 51 and the opening 61 are aligned to be open, and the opening 52 and the opening 62 are aligned to be open. A recording sheet enters the printer 10 through the openings 51 and 61, and is discharged through the openings 52 and 62. A sheet cassette 100 can be connected to the opening 61 with the openings 51 and 61 being open.

Print data are transmitted from an information terminal to the printer 10 through radio communications using, for example, Bluetooth Low Energy (BLE). The printer 10 receives the print data and performs printing on a recording sheet. The printer 10 contains a built-in antenna for performing radio communications.

The printer 10 includes a power supply 80 storing a lithium-ion battery, which is a rechargeable battery, and can be driven with electric power supplied from the lithium-ion battery. The printer 10 includes a built-in connector for charging a rechargeable battery.

The printer 10, which is approximately 18 mm in diameter and approximately 165 mm to 170 mm in length, can be carried around without feeling stress. The printer 10 includes a hook 90 which allows the printer 10 to be put in the chest pocket of clothes to be carried around just like a pen.

First Embodiment

Figure 8:
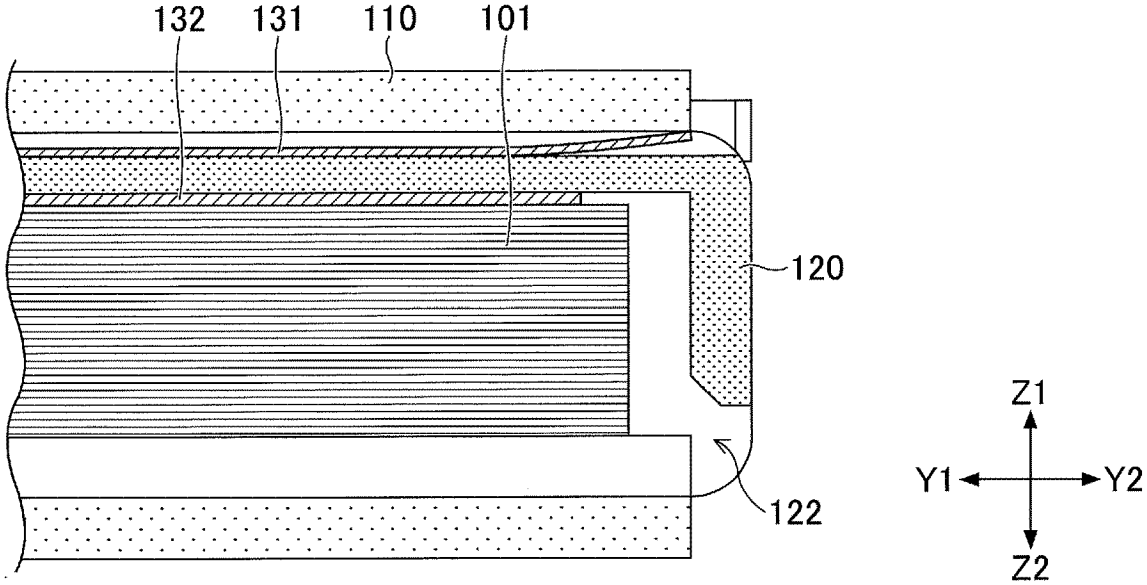
FIG. 8 is a partial enlarged view of a section of the sheet cassette according to the first embodiment.

The cassette 100 according to a first embodiment integrates the function of a case that stores cut sheets and the function of a cut sheet feeder that feeds a recording sheet to the printer 10. FIGS. 3, 4, 5, 6 and 7 are a top perspective view, a bottom perspective view, a top plan view, a front view and a sectional view, respectively, of the cassette 100. FIG. 8 is a partial enlarged view of a section of the cassette 100.

The cassette 100 is substantially a rectangular in appearance, and includes an outer cover 110 and a storage case 120. The cover 110 is open at its Y2 end. The case 120 is inserted into the outer cover 110 through the opening. In an upper surface 110*a* of the cover 110, grooves 111 are provided to extend one along each of the X1 side and the X2 side of the upper surface 110*a* from its Y2 end. A window 112 for supplying recording sheets is formed at a bottom surface 110*b* of the cover 110.

Figure 9:
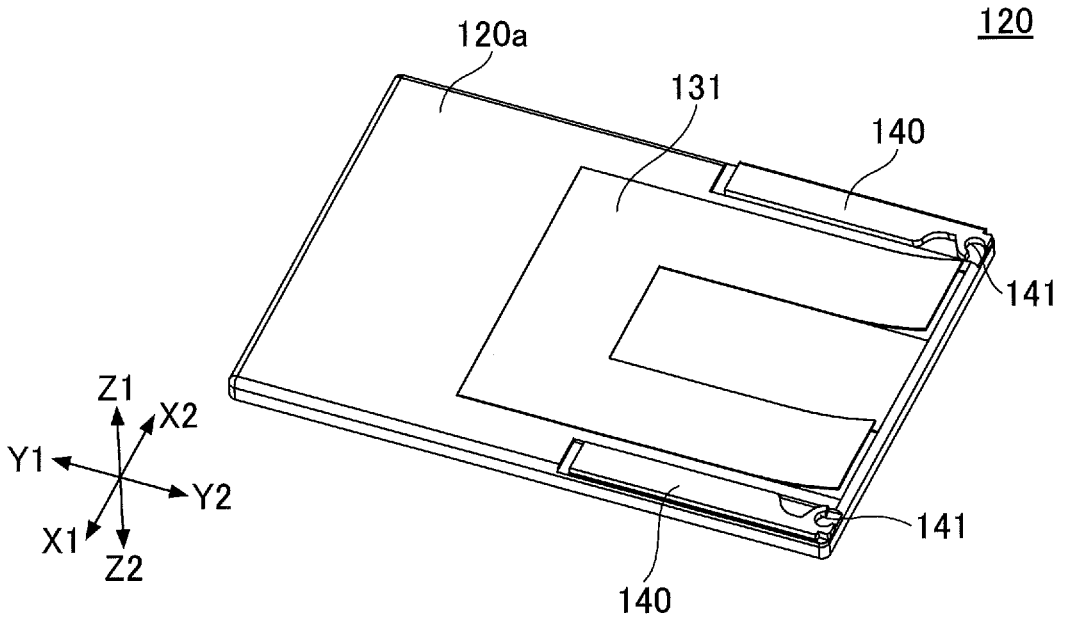
FIGS. 9, 10, 11 and 12 are diagrams illustrating a case according to the first embodiment.
Figure 10:
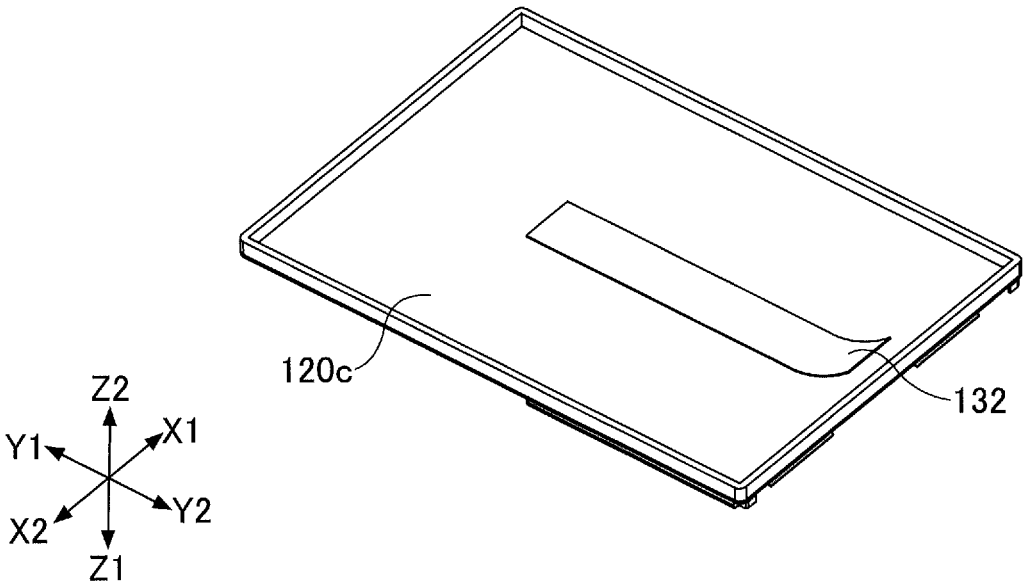
Figure 11:
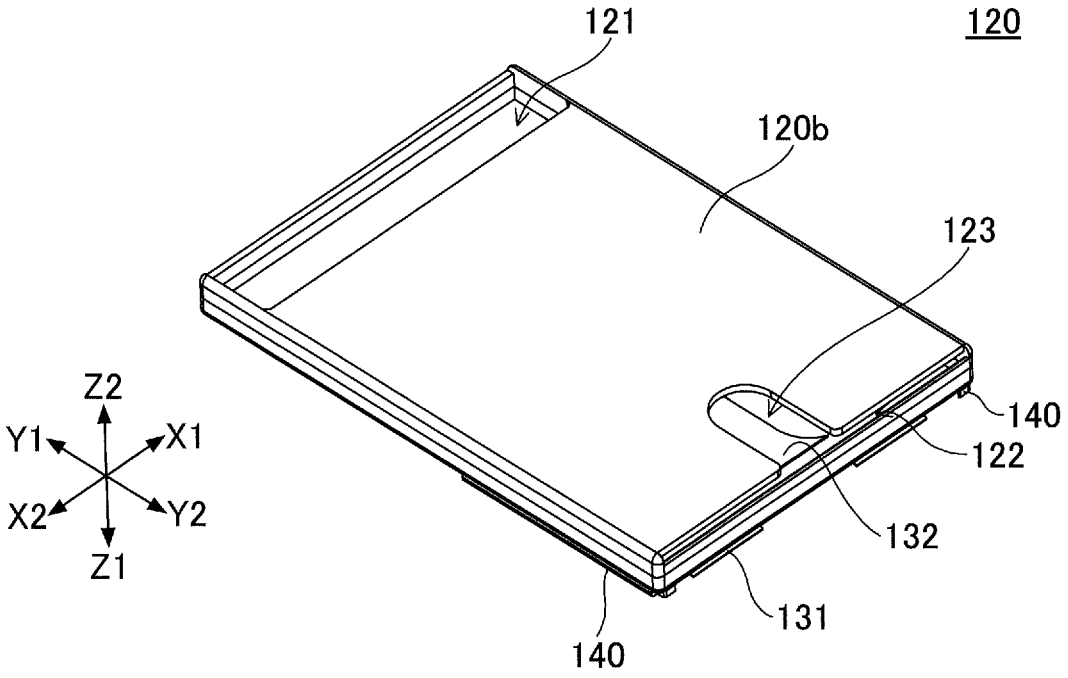
Figure 12:
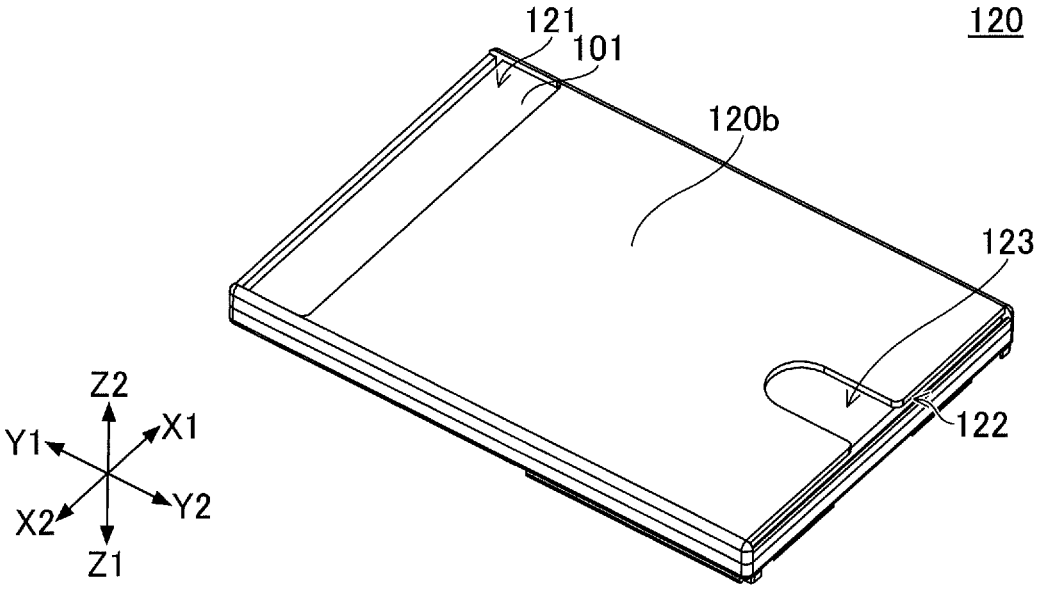

FIG. 9 is a top perspective view of the case 120. FIG. 10 is a bottom view of the case 120 from which a bottom-side portion is removed. FIGS. 11 and 12 are bottom perspective views of the case 120, illustrating the case 120 in which recording sheets 101 are not stored and the case 120 in which the recording sheets 101 are stored, respectively.

The substantially rectangular-shaped case 120 is accommodated inside the cover 110. A leaf spring 131 that urges a recording sheet in the Z1 direction with the case 120 accommodated in the cover 110 is attached to an upper surface 120*a* of the case 120. Connection supports 140 are provided one at each of the X1 end and the X2 end of the upper surface 120*a*. As described below, the spring 131 is provided to lift the recording sheet 101 on the cover 110 toward the printer 10 to make it easy for the recording sheet 101 to enter the printer 10. The supports 140 are attached to the case 120 in such a manner as to be pivotable about the Y direction. Claws 141 to connect to the shaft of the feed roller 13 are provided one at the Y2 end of each plate-shaped support 140.

A space for accommodating the recording sheets 101, for example, A8 cut sheets, is formed inside the case 120. The X direction and the Y direction are a transverse direction and a longitudinal direction, respectively, of this space. A window 121 for supplying the recording sheets 101 is provided at the Y1 end of a bottom surface 120*b* of the case 120. Furthermore, an opening 122 for taking out the recording sheets 101 and a window 123 for inserting a finger or the like to take out the recording sheets 101 from the opening 122 are provided at the Y2 end of the case 120.

Referring to FIG. 10, a spring 132 for taking out the recording sheets 101 is attached to an inside surface 120*c* of the case 120. The spring 132 contacts the recording sheets 101 in the case 120 and presses the recording sheets 101 toward the window 123. By moving a finger inserted into the window 123 in the Y2 direction while keeping the finger in contact with the recording sheets 101 in the case 120 in FIG. 12, the topmost recording sheet 101 can be taken out from the opening 122.

Figure 4:
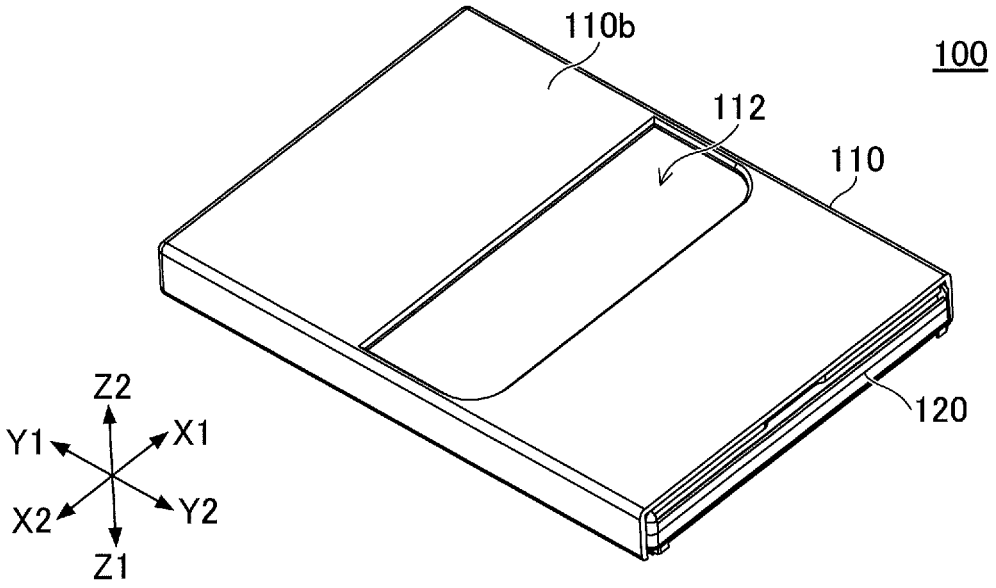
Figure 5:
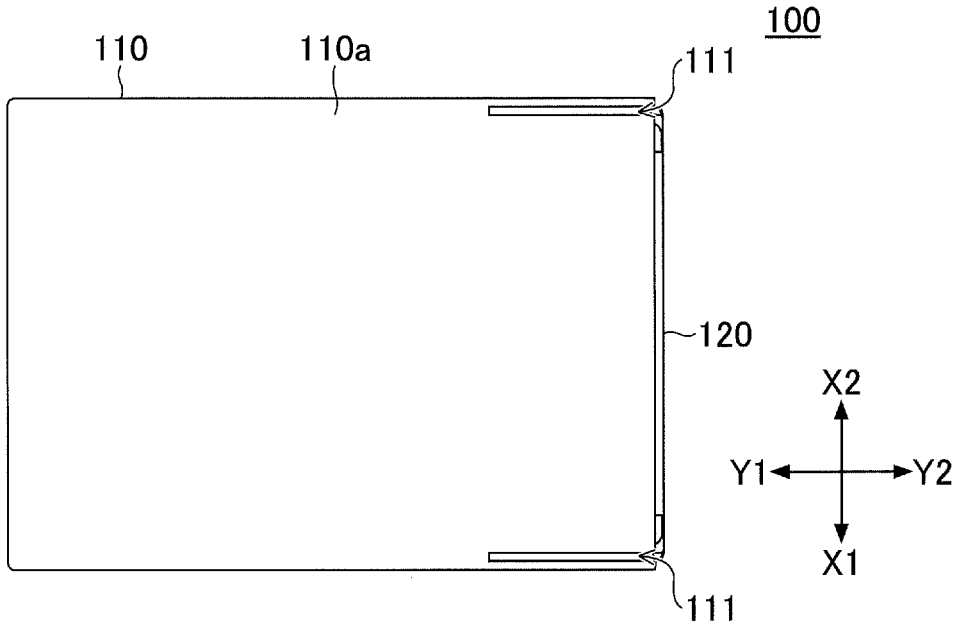
Figure 6:
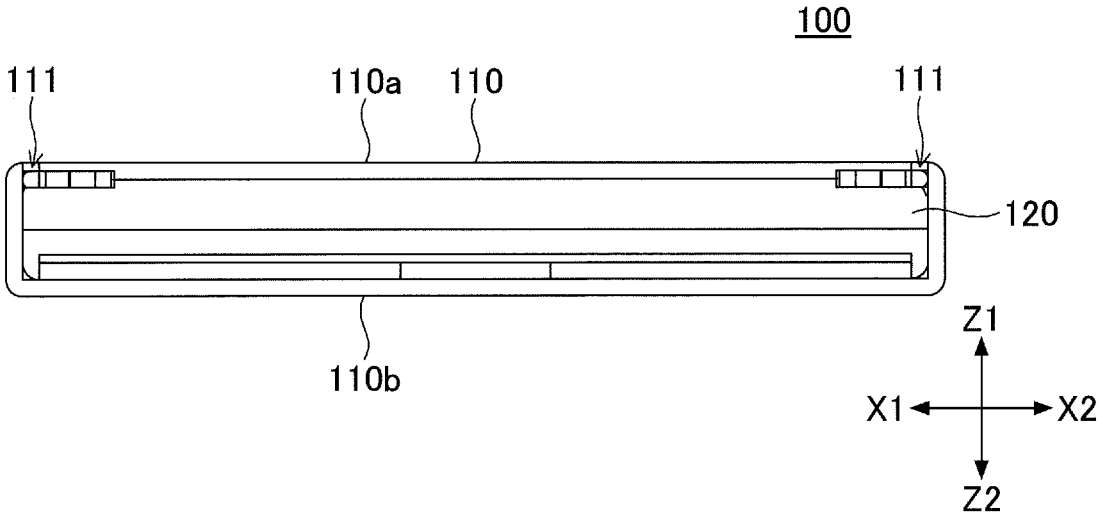
Figure 7:
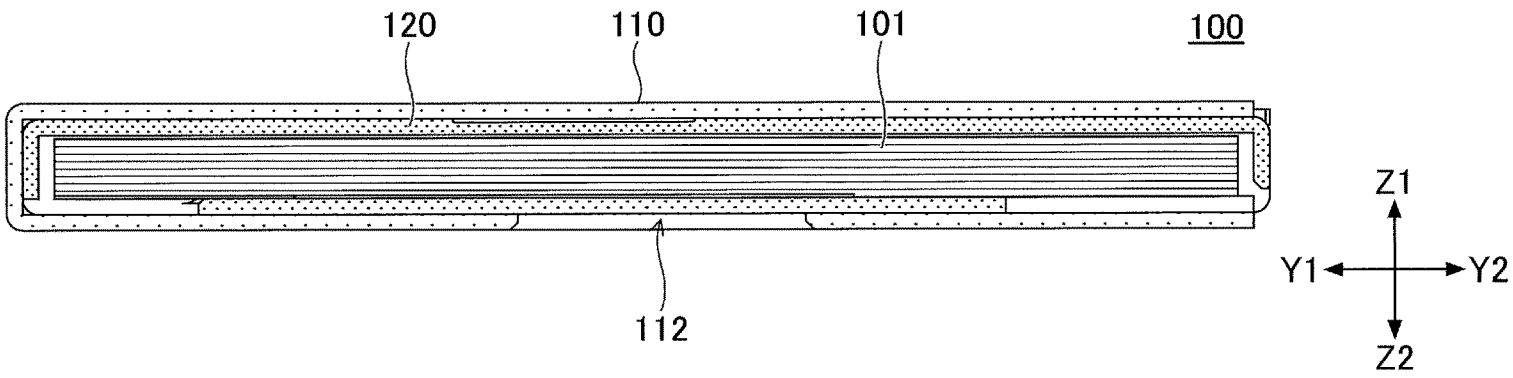
Figure 13:
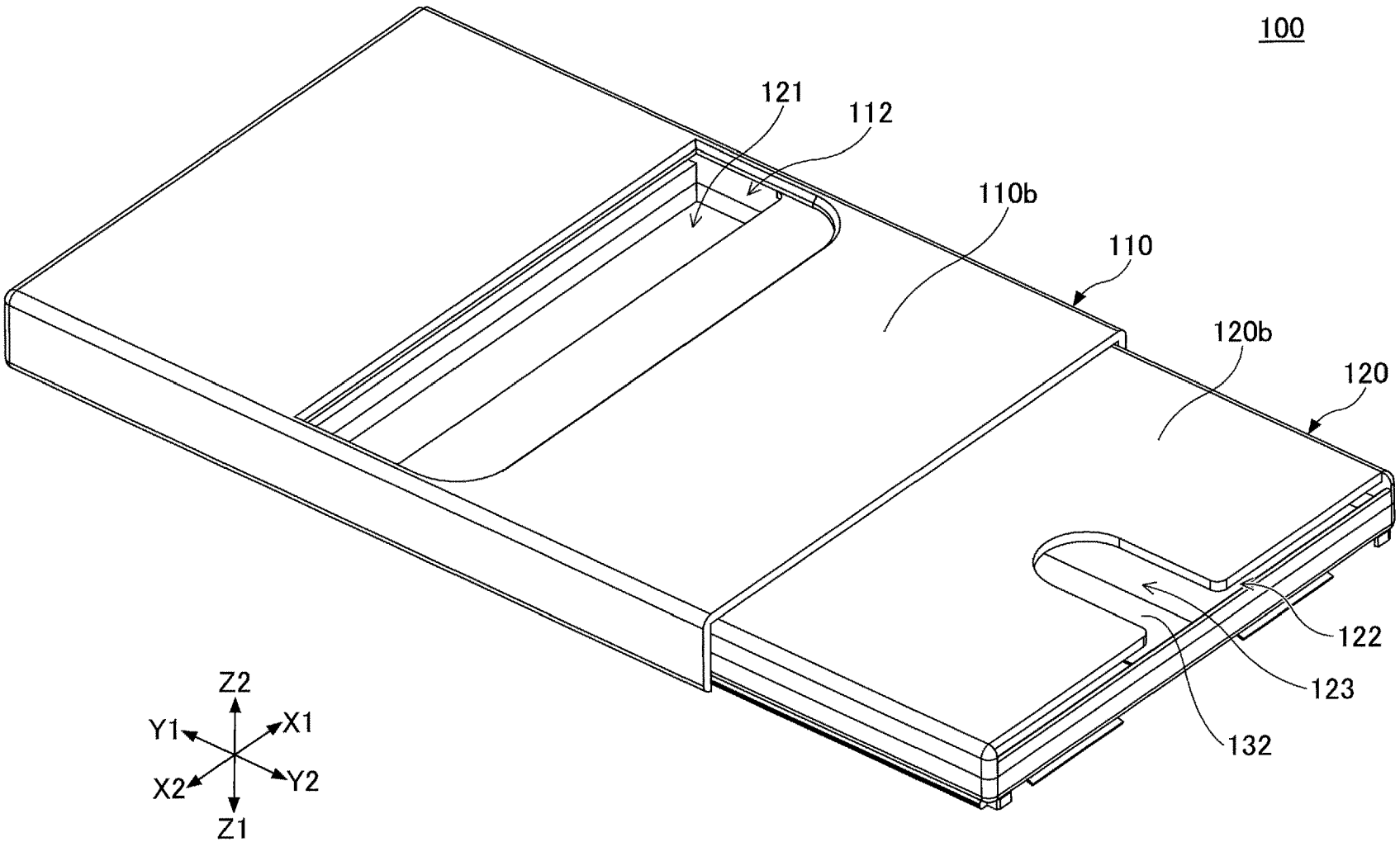
FIG. 13 is a diagram illustrating a method of supplying the sheet cassette with recording sheets according to the first embodiment.

To load the case 120 with the recording sheets 101, the cover 110 is slid in the Y1 direction relative to the case 120 from a position illustrated in FIG. 4 to align the window 112 with the window 121 as illustrated in FIG. 13, and the recording sheets 101 are placed into the case 120 through the windows 112 and 121. The windows 112 and 121 are slightly wider than the recording sheets 101 in the X direction. After placing the recording sheets 101 into the case 120, the cover 110 is slid in the Y2 direction from a position illustrated in FIG. 13 to a position illustrated in FIG. 12.

Figure 14:
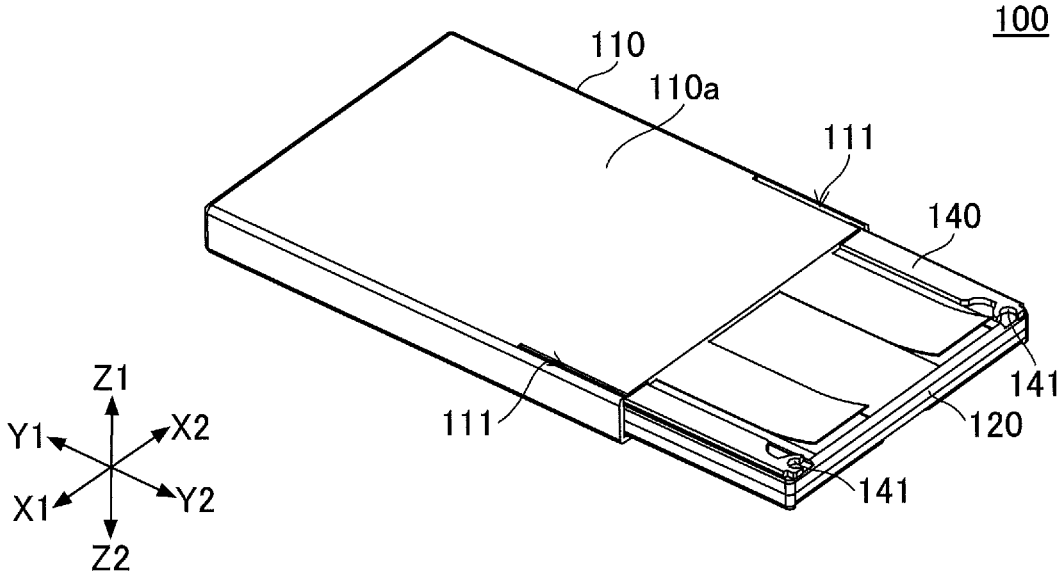
FIGS. 14, 15, 16, 17, 18, 19 and 20 are diagrams illustrating connection of the sheet cassette to the printer according to the first embodiment.

To connect the cassette 100 to the printer 10, the supports 140 attached to the case 120 are stood in the Z1 direction. The cover 110 is slid in the Y1 direction relative to the case 120 from a position illustrated in FIG. 3 to a position illustrated in FIG. 14. By further sliding the cover 110, the supports 140 are exposed and can stand as illustrated in FIG. 15.

The supports 140, which lie flat in the XY plane when accommodated in the cover 110, become pivotable about the Y direction when exposed as a result of the sliding of the cover 110. In this state, the supports 140 can pivot to stand in the Z1 direction to be parallel to the YZ plane. Recesses 124 complementary in shape to the supports 140 are provided on the case 120 to accommodate the supports 140 when the case 120 is inserted in the cover 110.

Figure 15:
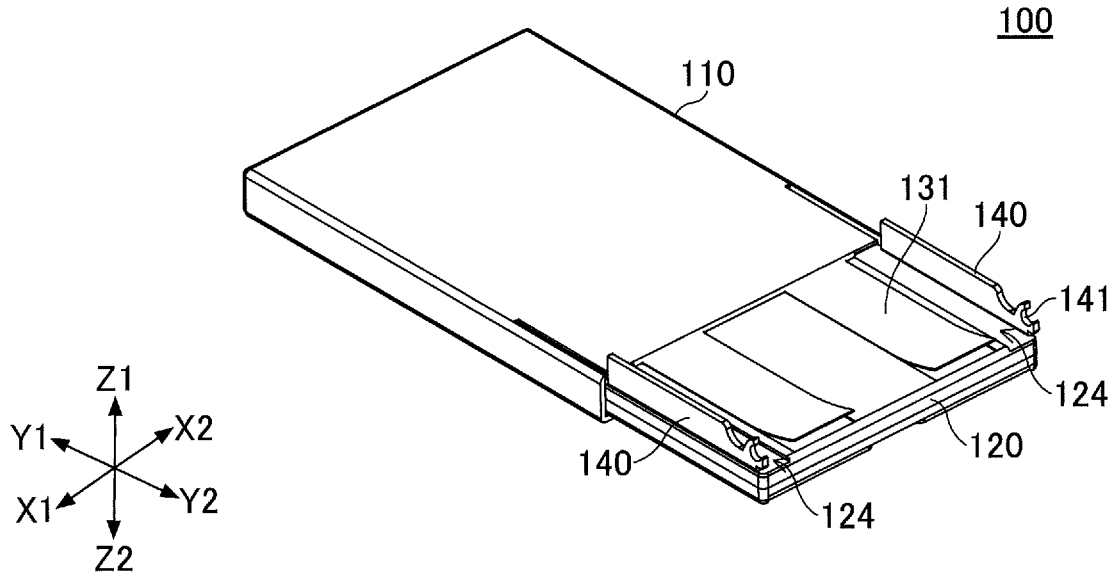
Figure 16:
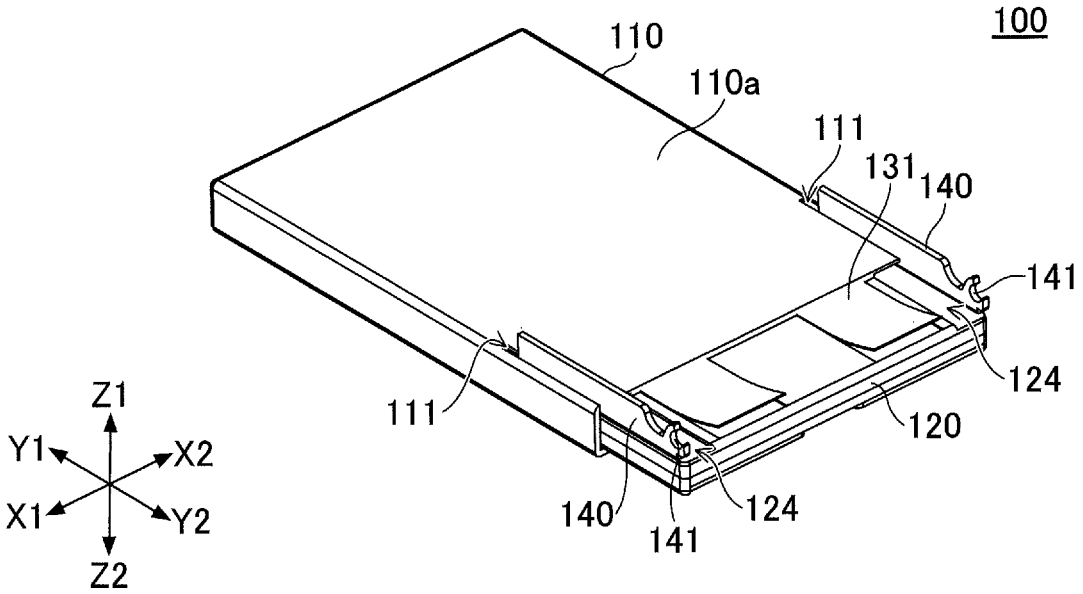
Figure 17:
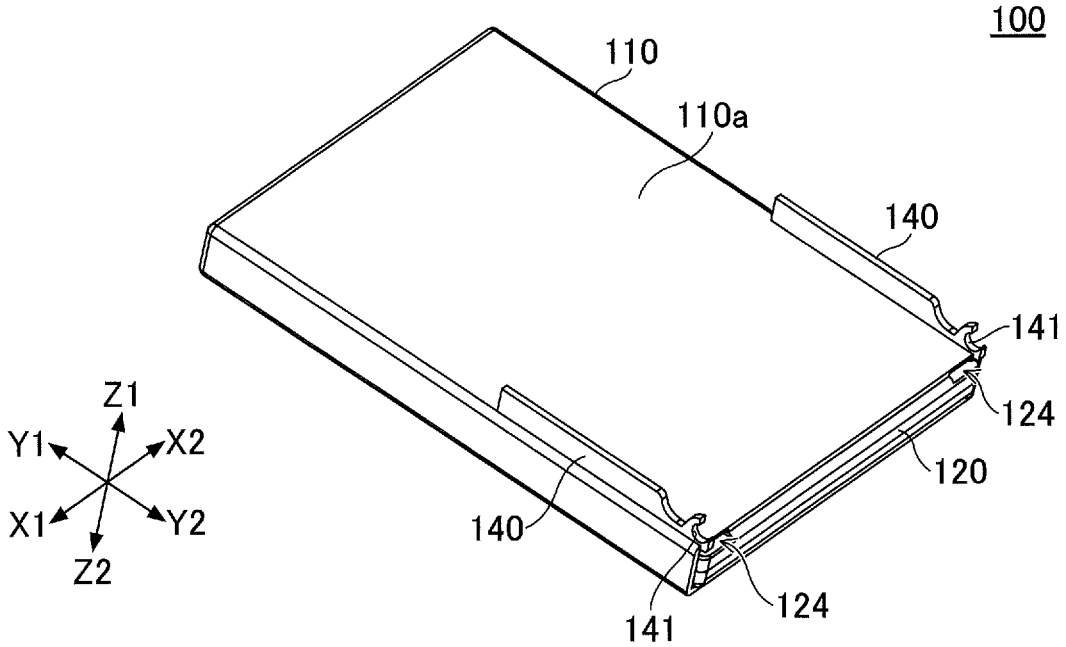

After standing the supports 140 as illustrated in FIG. 15, the cover 110 is slid in the Y2 direction. As a result, the plate-shaped supports 140 enter the grooves 111, and the supports 140 are supported by the grooves 111 to be kept standing as illustrated in FIG. 16. The cover 110 is further slid in the Y2 direction from a position illustrated FIG. 16 to a position illustrated in FIG. 17 relative to the case 120.

Figure 18:
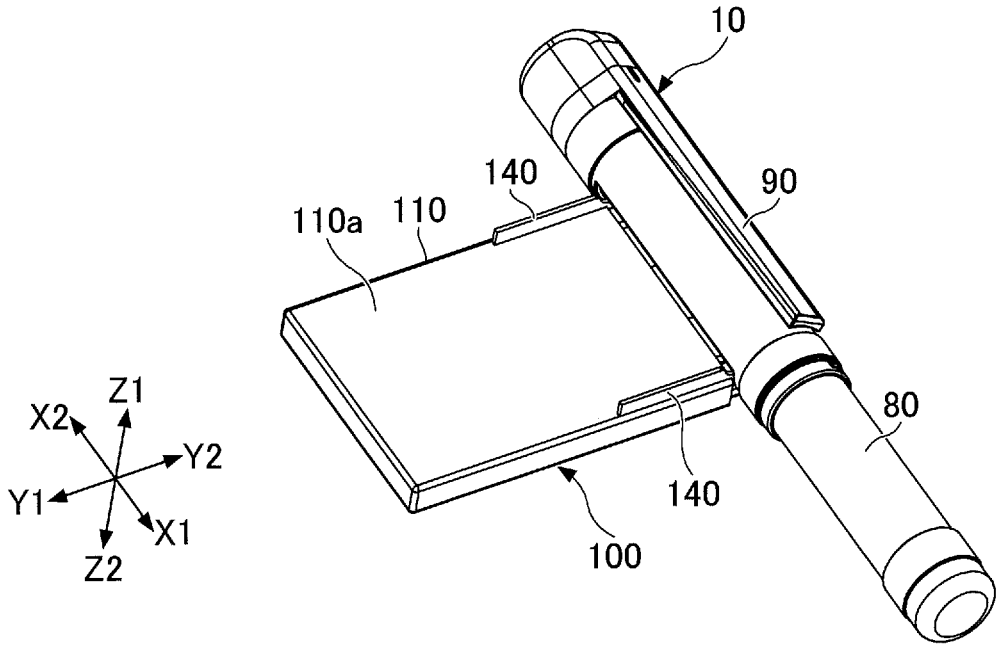
Figure 19:
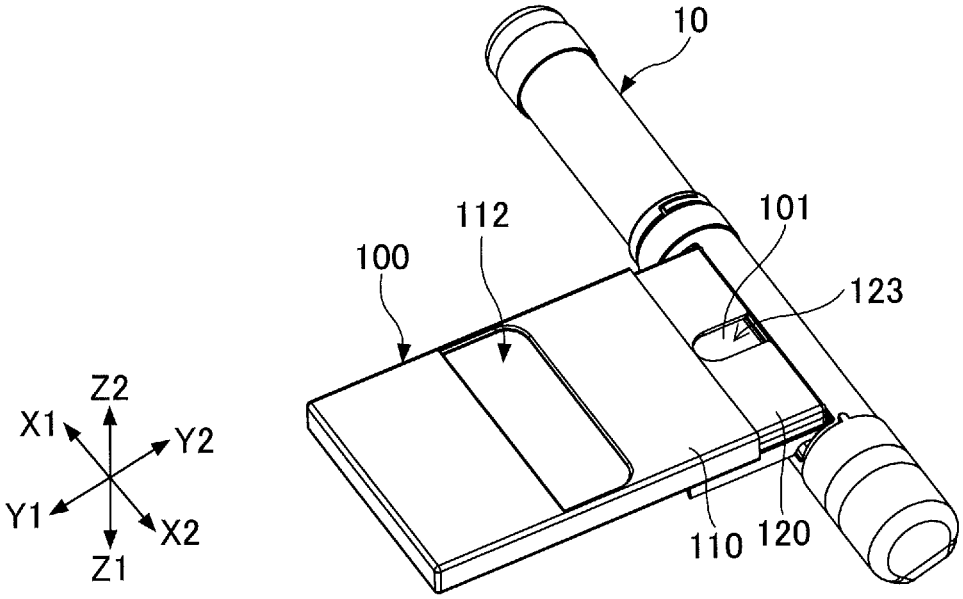
Figure 20:
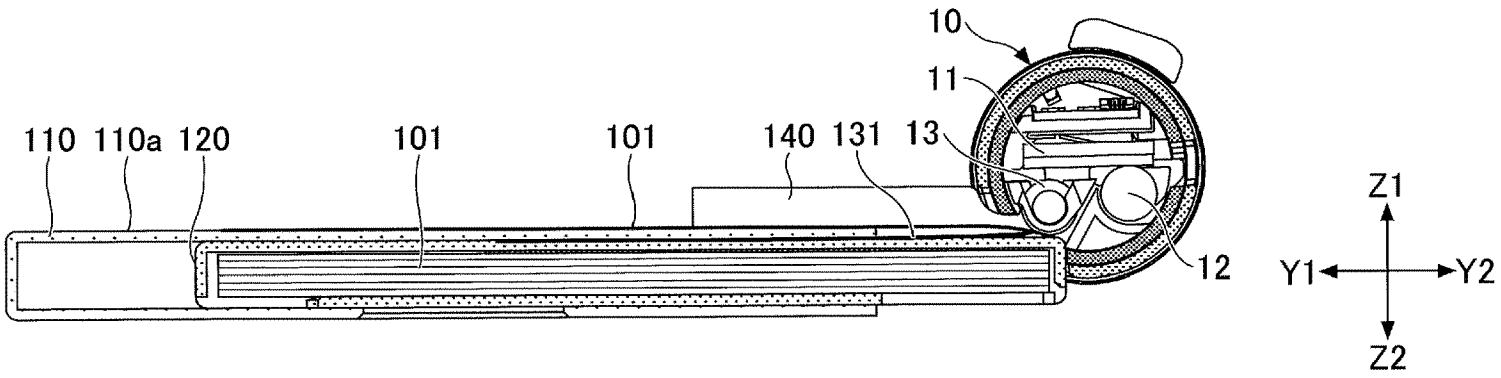

FIGS. 18, 19 and 20 are a top perspective view, a bottom perspective view, and a sectional view, respectively, of the printer 10 to which the cassette 100 is connected. Referring to FIGS. 18 through 20, the cassette 100 is connected to the printer 10 with the supports 140 provided with the claws 141 standing. The cover 110 is slightly slid in the Y1 direction relative to the case 120, and with the spring 131 partly exposed, the claws 141 are hooked on the shaft of the feed roller 13 to connect the cassette 100 to the printer 10. In this state, the recording sheet 101 placed on the cover 110 is lifted upward by the spring 131.

Figure 22:
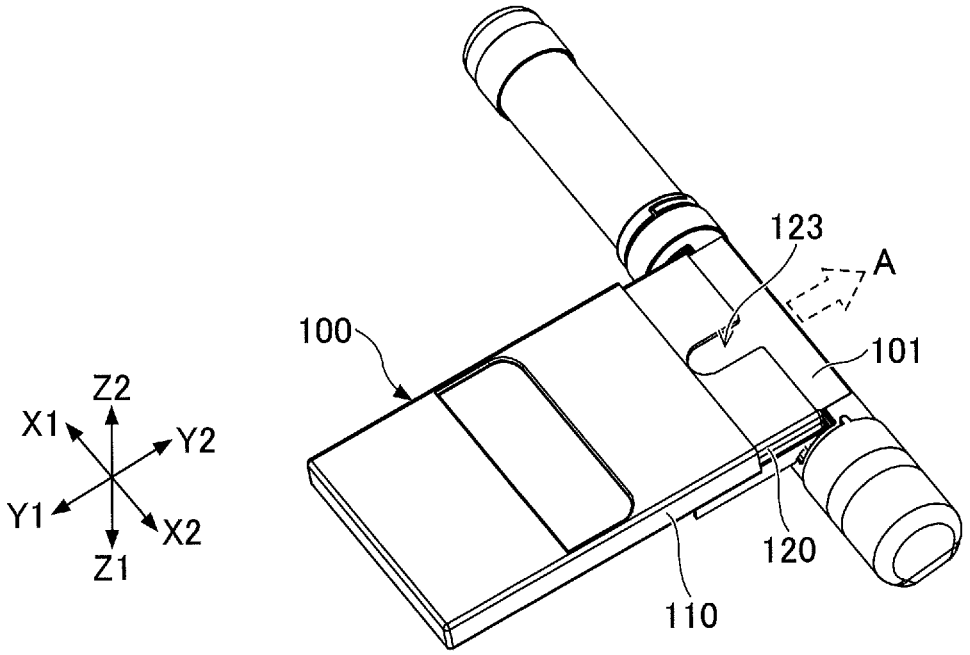
FIGS. 22, 23, 24 and 25 are diagrams illustrating placement of a recording sheet according to the first embodiment.

A recording sheet is fed with the cassette 100 connected to the printer 10. With the cassette 100 connected to the printer 10 as illustrated in FIG. 19, a finger is placed in the window 123 to move the topmost recording sheet 101 in the Y2 direction as indicated by the arrow A in FIG. 22 to extract one of the recording sheets 101 from the case 120. In the state illustrated in FIG. 19, the window 121 is closed with a region of the cover 110 in which the window 112 is not provided.

Figure 23:
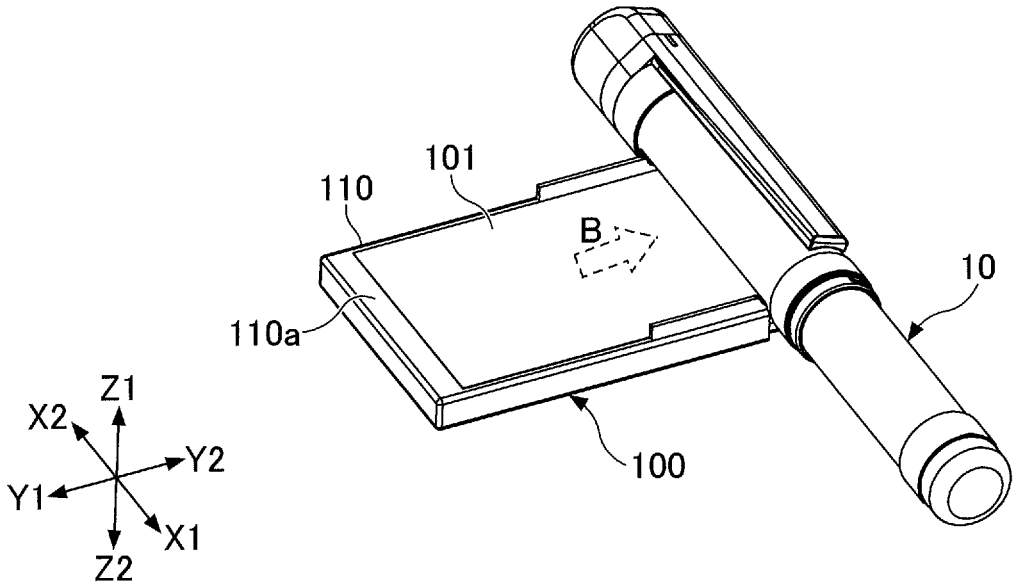
Figure 24:
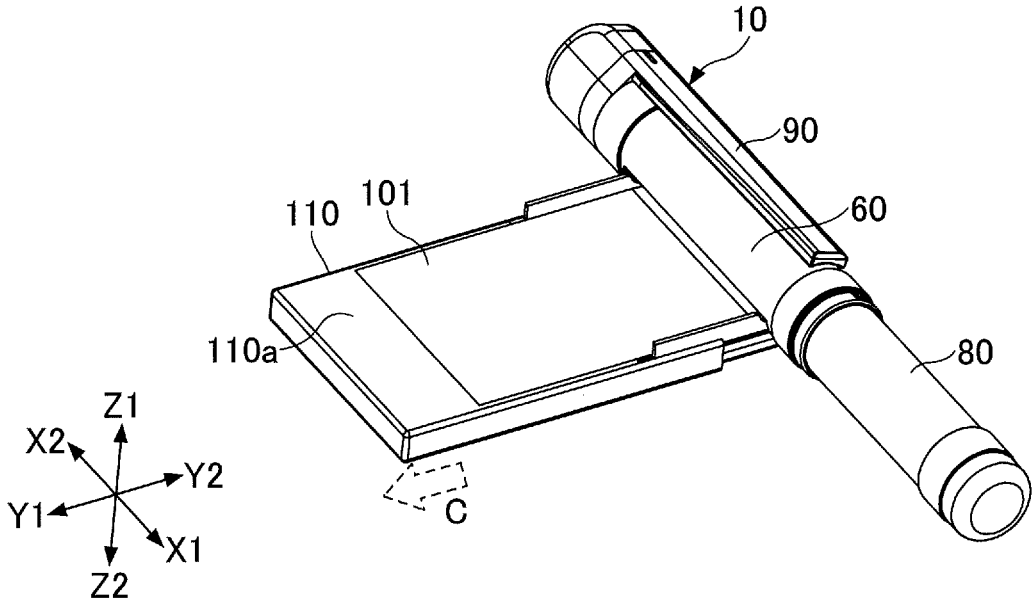
Figure 25:
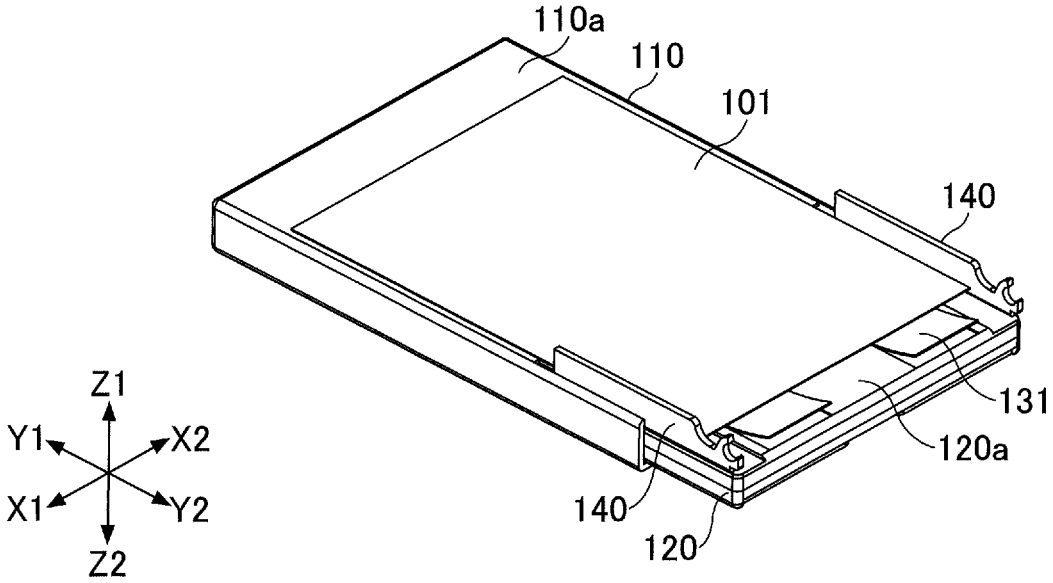

Next, as illustrated in FIG. 23, the extracted recording sheet 101 is placed on the upper surface 110*a*, and is moved toward the printer 10 as indicated by the arrow B to be inserted into the printer 10. Then, as illustrated in FIG. 24, the cover 110 is slightly slid as indicated by the arrow C. As a result, as illustrated in FIG. 25, the spring 131 provided on the upper surface 120*a* is exposed outside the cover 110, so that the recording sheet 101 is lifted toward the printer 10 by the spring 131 to contact the feed roller 13. This makes the recording sheet 101 easily feedable. FIG. 25 illustrates the cassette 100 removed from the printer 10 with the spring 131 exposed. The supports 140 also serve as sheet guides to guide the recording sheet 101 on both sides.

Figure 21:
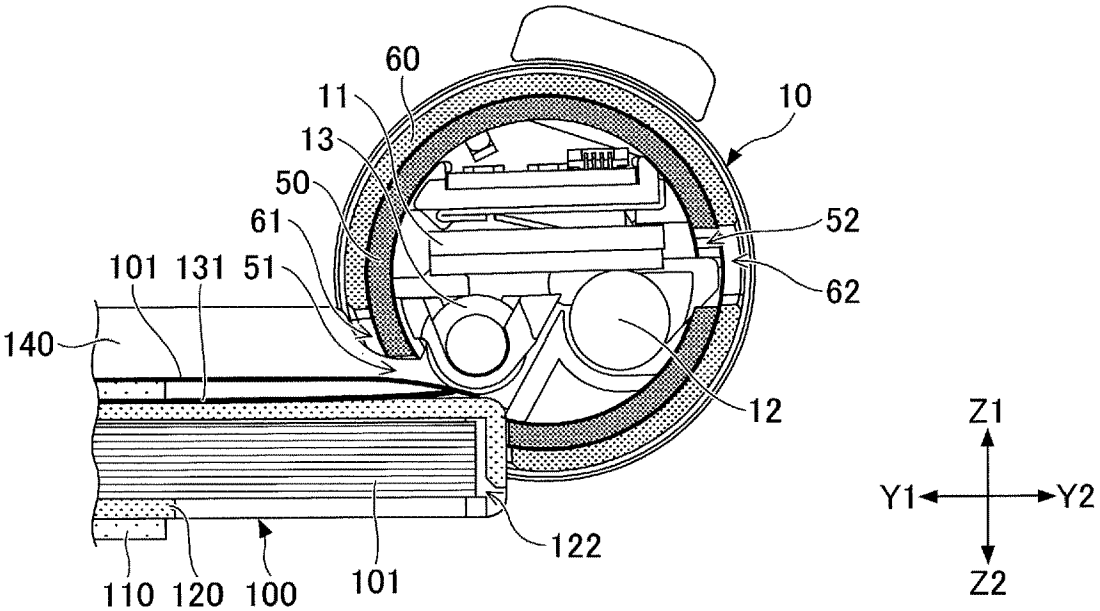
FIG. 21 is a diagram illustrating printing using the sheet cassette according to the first embodiment.

By sliding the cover 110 in the Y1 direction to expose the spring 131 to lift up the Y2 end of the recording sheet 101 on the upper surface 110*a*, it is possible to ensure the contact of the recording sheet 101 with the feed roller 13 as illustrated in FIG. 21. In contrast, in the state illustrated in FIG. 23, the cover 110 is closed, so that the spring 131 is not exposed. Therefore, the spring 131 does not apply an urging force to the recording sheet 101 on the upper surface 110*a*, thus causing no problem in inserting the recording sheet 101 in the direction of the arrow B.

In FIG. 25, for convenience of description of the spring 131, the leading edge of the recording sheet 101 is depicted as being positioned slightly farther in the Y1 direction than actually is at the time of feeding.

Referring to FIG. 24, when printing starts, the recording sheet 101 placed on the upper surface 110*a* is fed into the printer 10 by the feed roller 13. Thereafter, when a sensor in the printer 10 detects the leading edge of the recording sheet 101, it is determined that the recording sheet 101 is taken in, and the recording sheet 101 is fed further into the printer 10 to be subjected to printing.

According to this embodiment, the cassette 100 integrates the functions of storing the recording sheets 101 and the function of a cut sheet feeder. Therefore, compared with the case of providing mechanisms for these functions separately, it is possible to provide a small, light sheet cassette that is also easy to carry.

Second Embodiment

A sheet cassette 200 according to a second embodiment integrates the function of a case that stores cut sheets and the function of a cut sheet feeder. FIGS. 26, 27, 28, 29, 30 and 31 are a top perspective view, a bottom perspective view, a front view, a rear view, a side view and a sectional view, respectively, of the cassette 200. FIG. 32 illustrates the cassette 200 from which an outer cover 210 is removed.

The cassette 200 includes the cover 210, a case 220, and a lid 240. The cover 210 includes a top plate 210*a* and side plates 210*b* that extend in the Z2 direction from the X1-side edge and the X2-side edge, respectively, of the top plate 210*a*. Each side plate 210*b* includes a first hole 211 near the Y1 end and a second hole 212 at the Y2 end, each of which is elongated in the Y direction. While both longitudinal ends of the first hole 211 are closed, the Y2 end of the second hole 212 is open to form an opening 212*a*.

Figure 31:
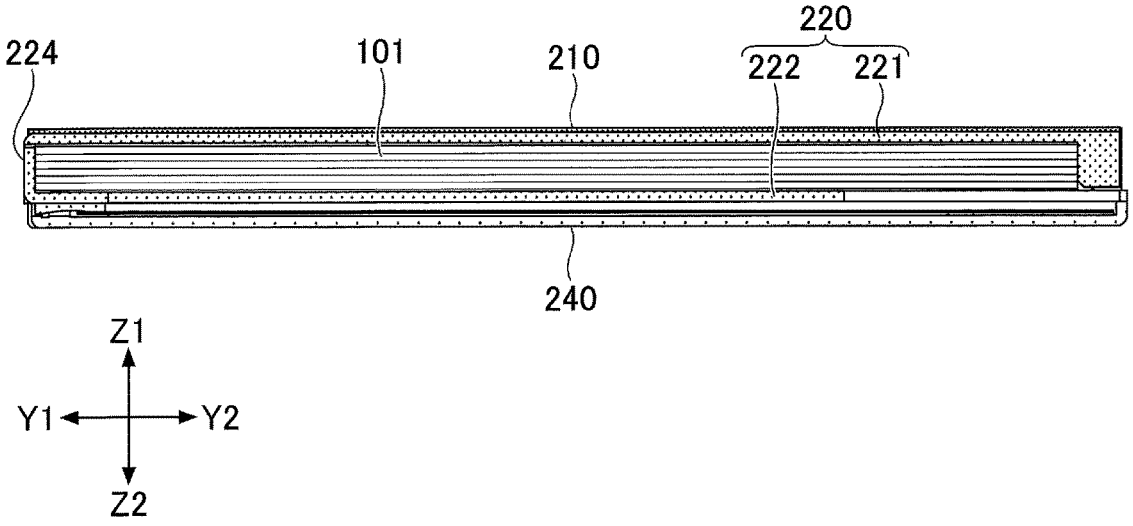
Figure 32:
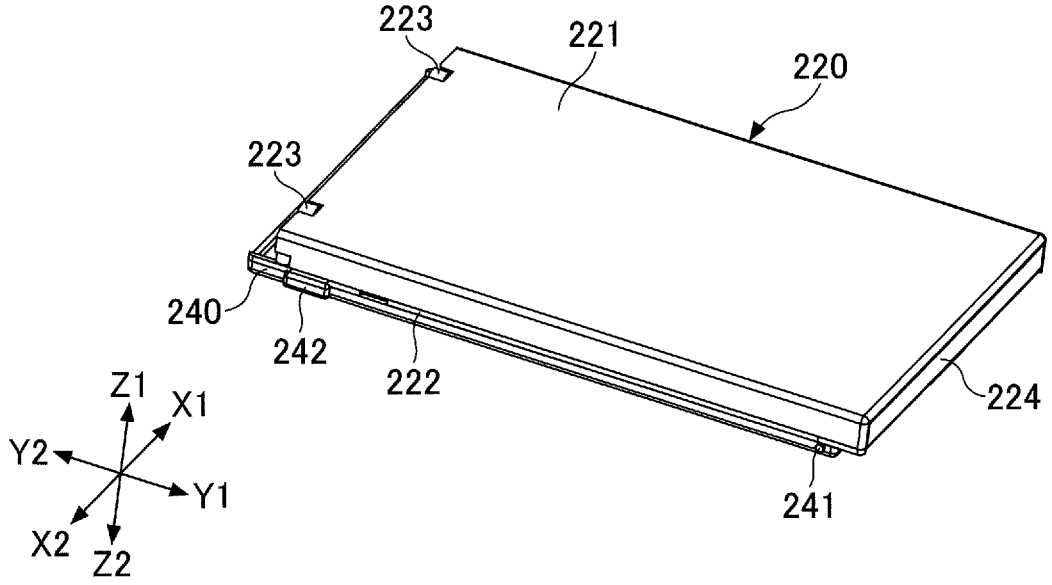
FIGS. 32, 33, 34 and 35 are diagrams illustrating the sheet cassette according to the second embodiment.

Referring to FIG. 31, the case 220 includes an inner case 221 and an inner lid 222 attached thereto. When accommodated in the cover 210, the Z1 surface, the X1 surface, and the X2 surface of the case 220 are covered with the cover 210. The recording sheets 101 are stored in a space surrounded by the case 221 and the inner lid 222.

Two claws 223 for connecting the cassette 200 to the printer 10 are provided at the Y2 end of the case 221. A lid 224 that opens to allow loading of the recording sheets 101 is provided at the Y1 end of the case 221.

Figure 33:
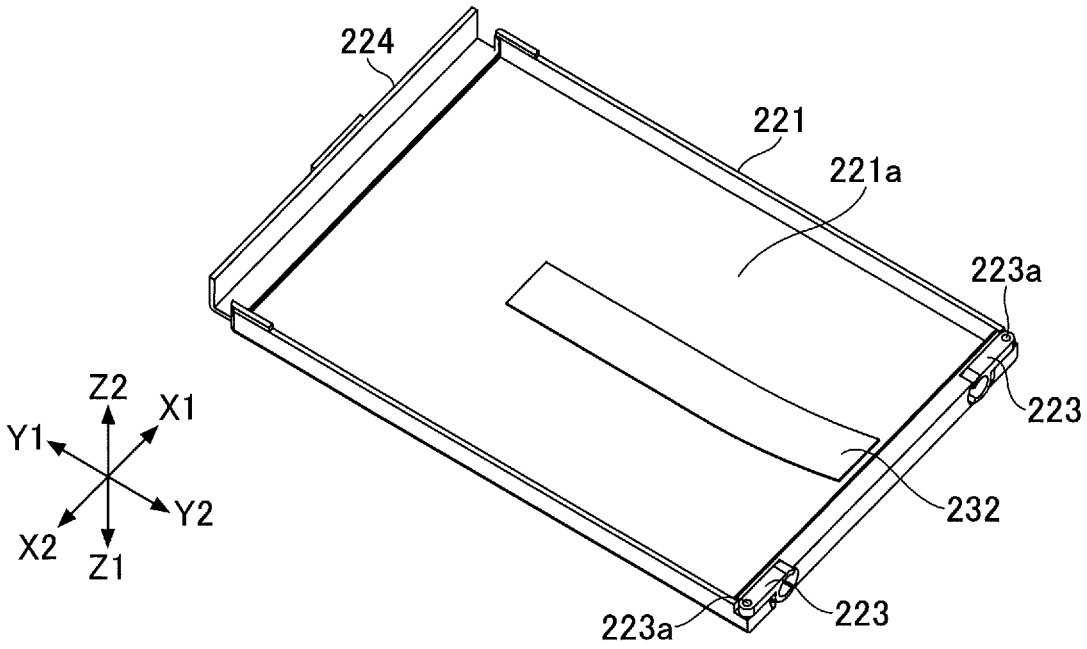

Referring to FIG. 33, a spring 232 is provided on an inside top surface 221*a* of the case 221. The spring 232 presses the recording sheets 101 stored in the case 220 in the Z2 direction to make it easy to take out the recording sheets 101. The claws 223 are attached to the case 221 in such a manner as to be pivotable about respective shafts 223*a* extending in the Z direction. The lid 224 is attached to the case 221 in such a manner as to be pivotable about the X direction.

Figure 34:
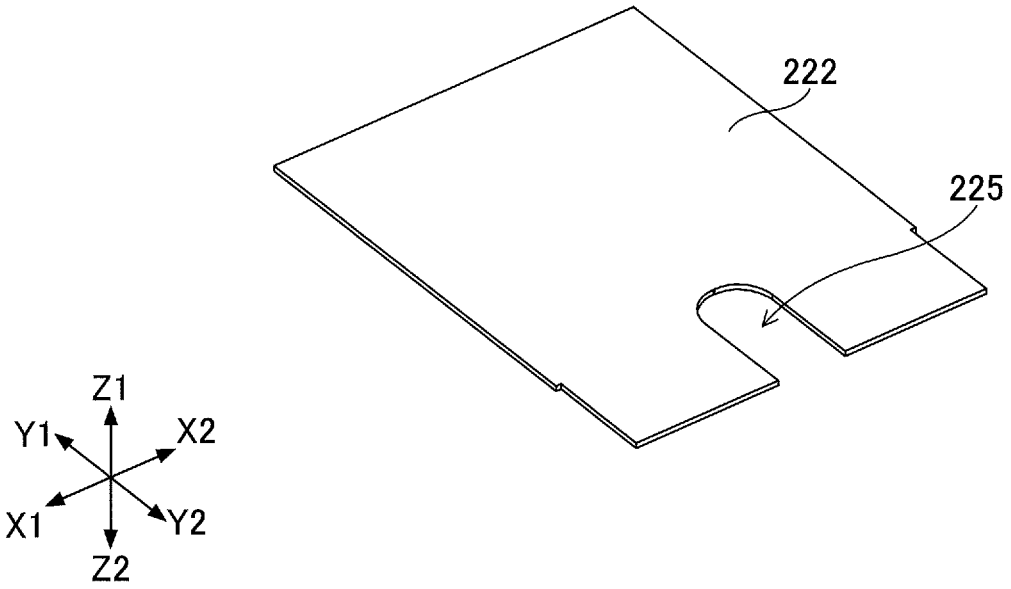

Referring to FIG. 34, the plate-shaped inner lid 222 is attached to the Z2 side of the case 221. An opening 225 for inserting a finger to take out the recording sheets 101 inside is formed at the Y2 end of the inner lid 222.

Figure 26:
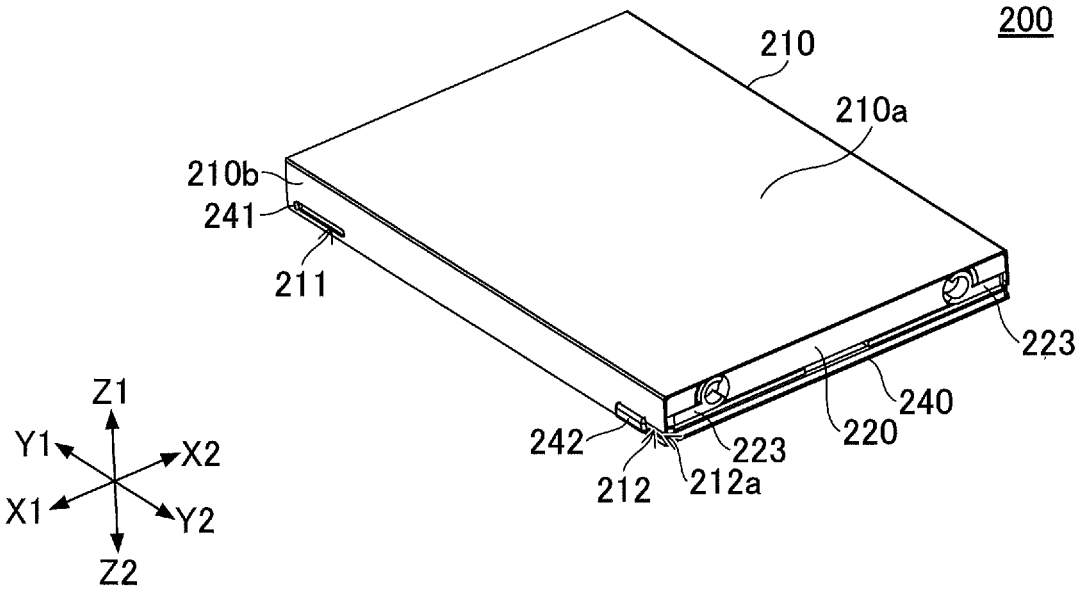
FIGS. 26, 27, 28, 29, 30 and 31 are a top perspective view, a bottom perspective view, a front view, a rear view, a side view and a sectional view, respectively, of a sheet cassette according to a second embodiment.
Figure 27:
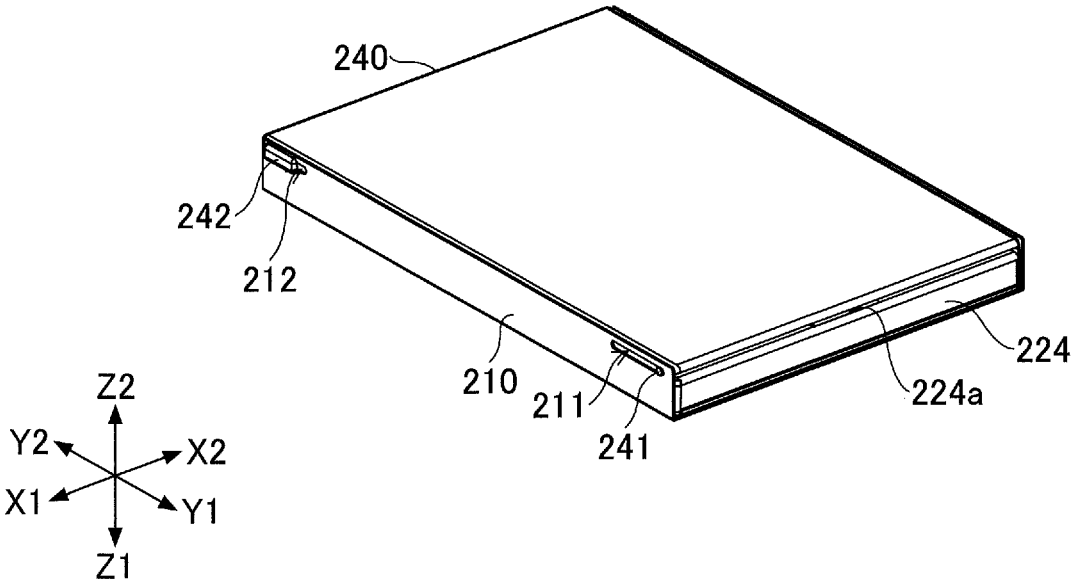
Figure 28:
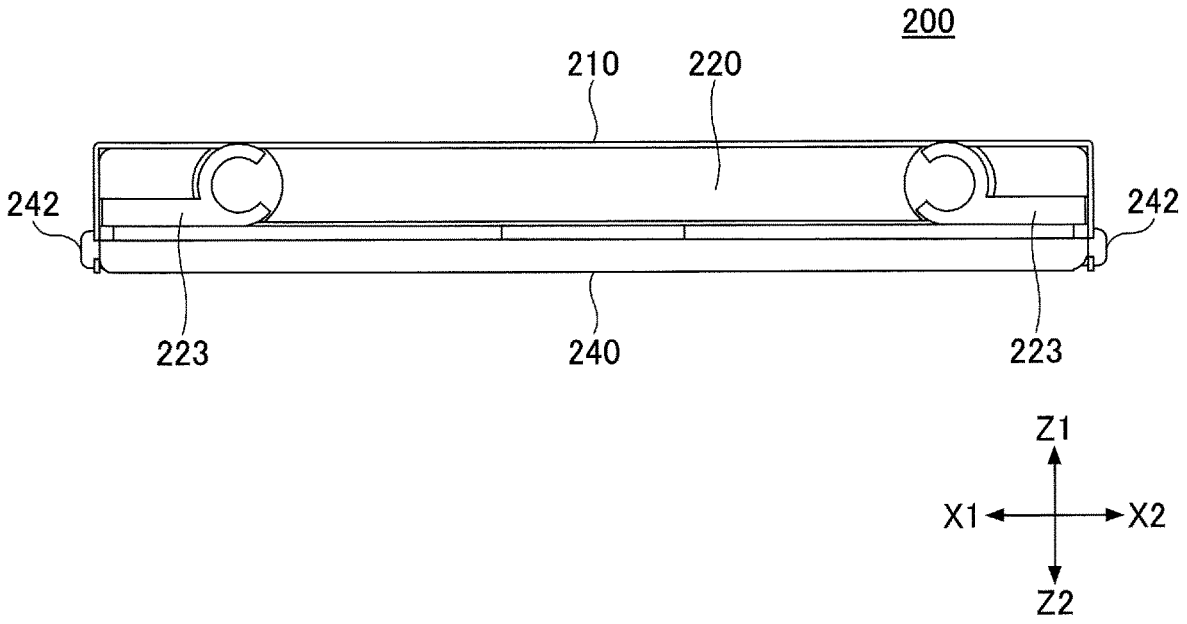
Figure 29:
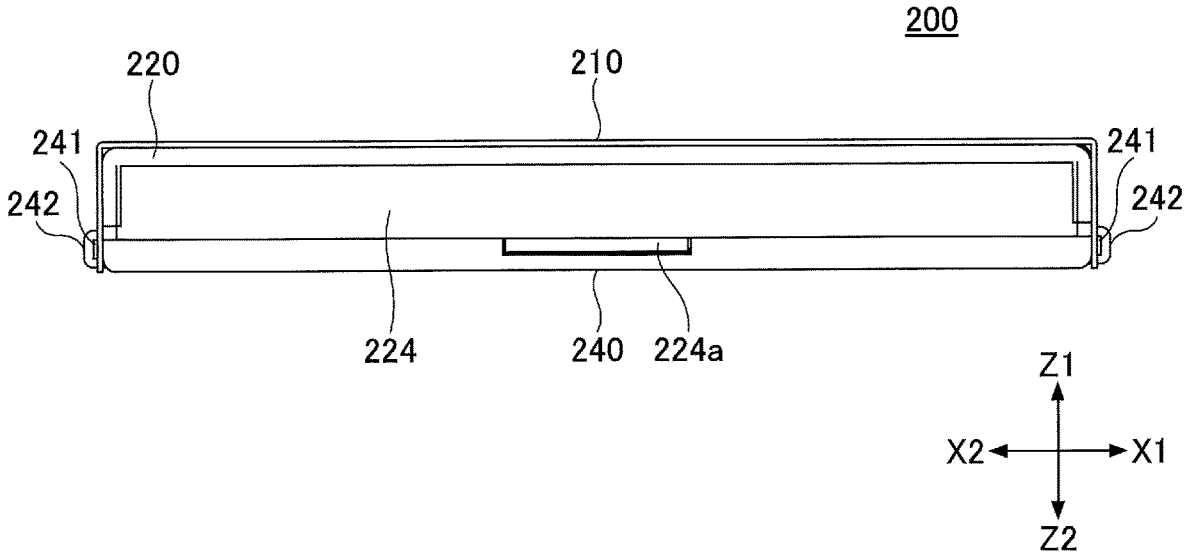
Figure 30:
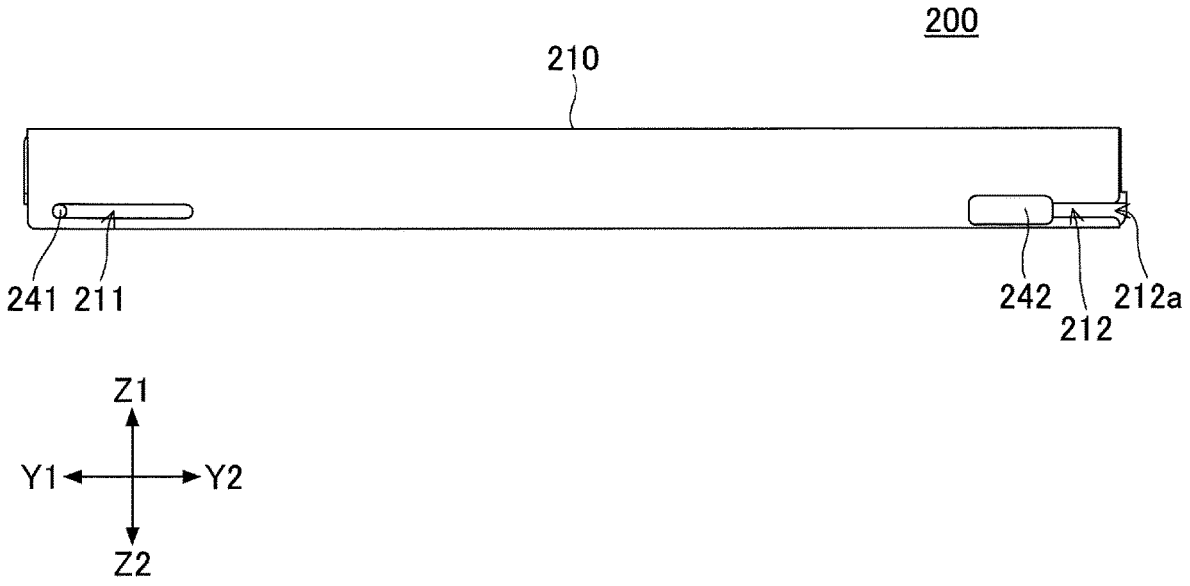
Figure 35:
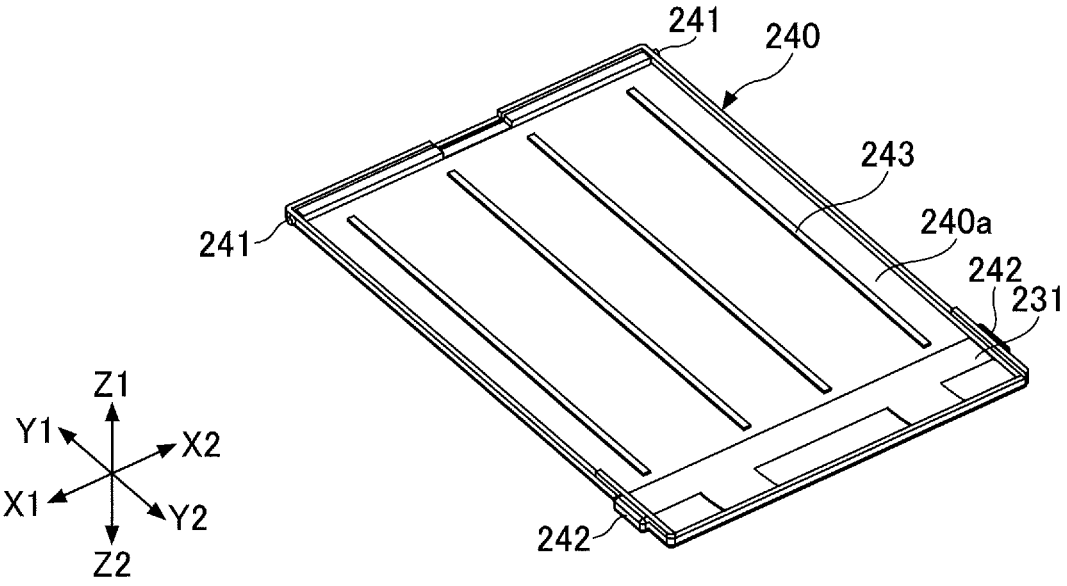

The openable lid 240 is provided at the bottom of the case 220. Referring to FIG. 35, each of the X1 surface and the X2 surface of the lid 240 includes a first protrusion 241 at the Y1 end and a second protrusion 242 near the Y2 end. The first protrusion 241 has a pin shape or cylindrical shape. The second protrusion 242 is substantially a rectangular in shape to be easily operable. Referring to FIGS. 26 and 30, when the cassette 200 is assembled, the first protrusion 241 is in the corresponding first hole 211 to be freely movable within the first hole 211, and the second protrusion 242 is freely movable within the corresponding second hole 212 and can move outside from the opening 212*a*. Referring to FIG. 28, the second protrusion 242 has an H shape in the ZX plane, and a narrowed portion of the second protrusion 242 is accommodated in the second hole 212.

Referring to FIG. 35, a spring 231 is provided at the Y2 end of an inside surface 240*a* of the lid 240. The leaf spring 231 exerts an urging force in the Z1 direction with the lid 240 closed as illustrated in FIG. 26 or 31. The recording sheet 101 placed between the case 220 and the lid 240 can be pressed upward toward the printer 10 by the spring 231.

Figure 36:
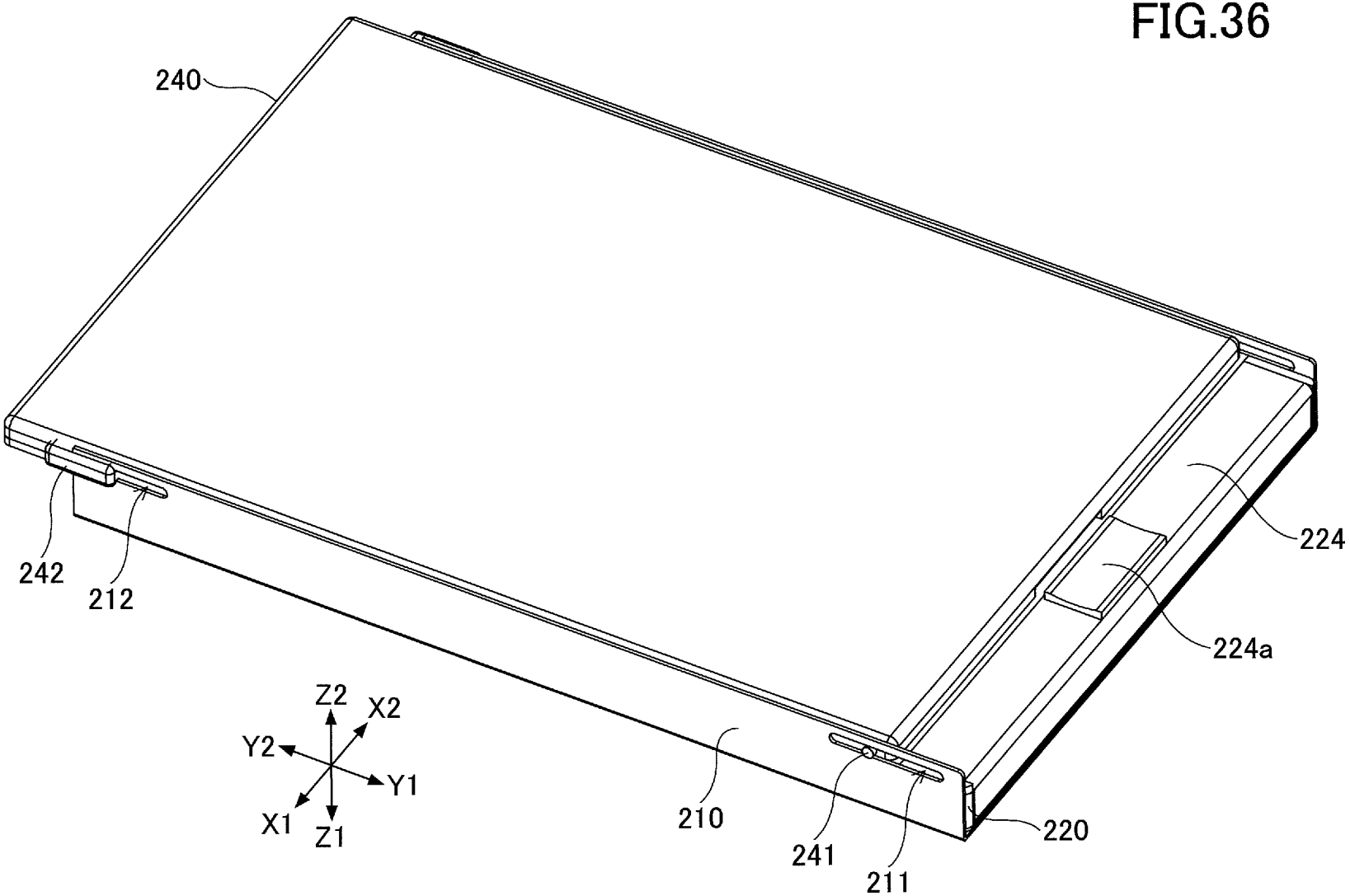
FIGS. 36, 37 and 38 are diagrams illustrating a method of supplying the sheet cassette with recording sheets according to the second embodiment.

To supply the case 220 with the recording sheets 101, the lid 240 is slid in the Y2 direction to expose the Z2 surface of the lid 224 as illustrated in FIG. 36. At this point, the case 220 does not move relative to the cover 210.

When the lid 240 is slid in the Y2 direction, the first protrusions 241 move in the first holes 211, and the second protrusions 242 move in the second holes 212. The second protrusions 242 may partly protrude outward from the openings 212*a*.

Figure 37:
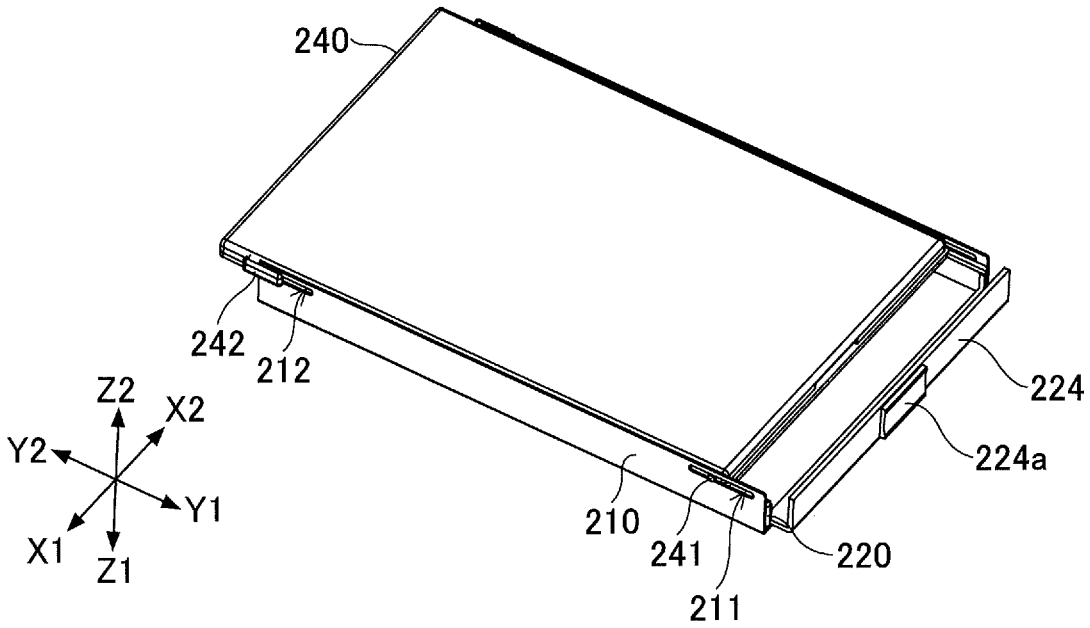
Figure 38:
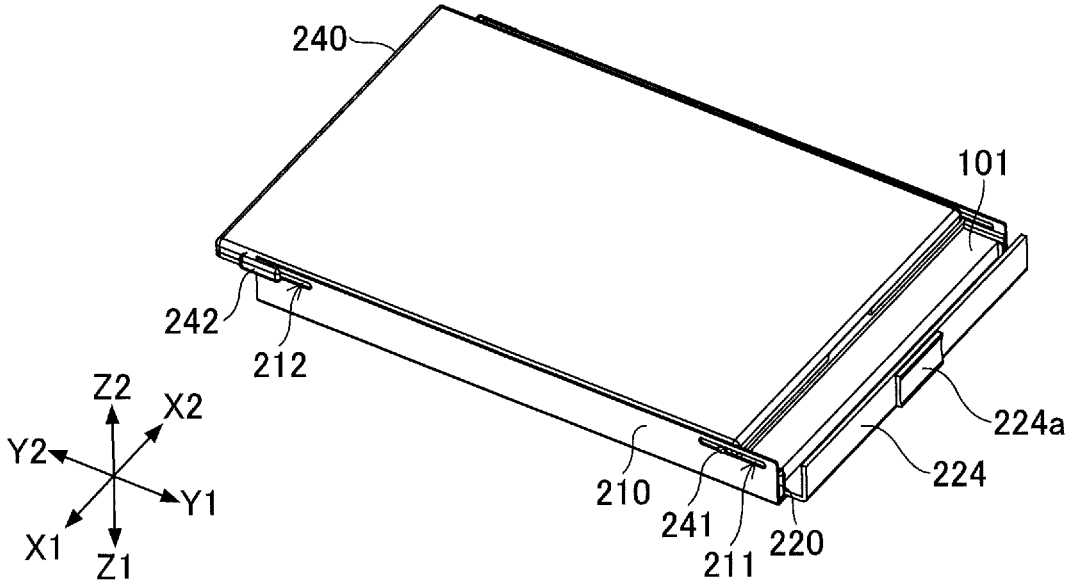

Next, a finger is brought into contact with a hook 224*a* provided on the lid 224 to tilt the lid 224 to the Y1 side from a position illustrated in FIG. 36. As a result, the lid 224 pivots about the X direction to open as illustrated in FIG. 37. In this state, the recording sheets 101 are loaded into the case 220 through an opening created by the opened lid 224 as illustrated in FIG. 38. Thereafter, the lid 224 is pivoted in the Y2 direction to be returned to the position illustrated in FIG. 36. Thereafter, the lid 240 is slid in the Y1 direction to be returned to a position illustrated in FIG. 27.

Figure 39:
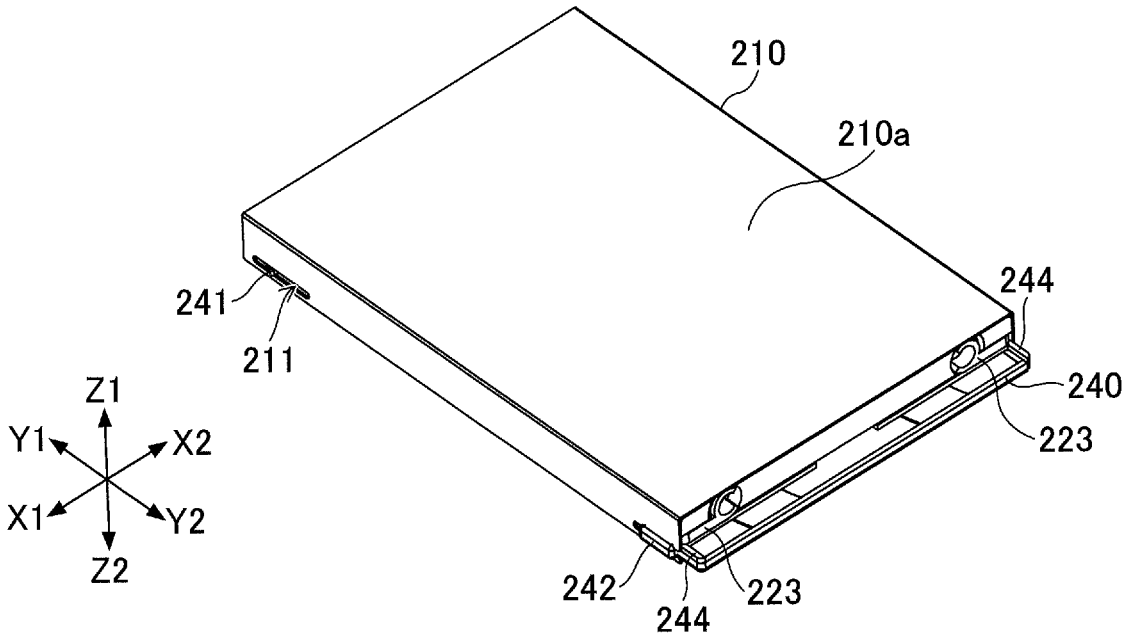
FIGS. 39, 40, 41 and 42 are diagrams illustrating connection of the sheet cassette to the printer according to the second embodiment.
Figure 40:
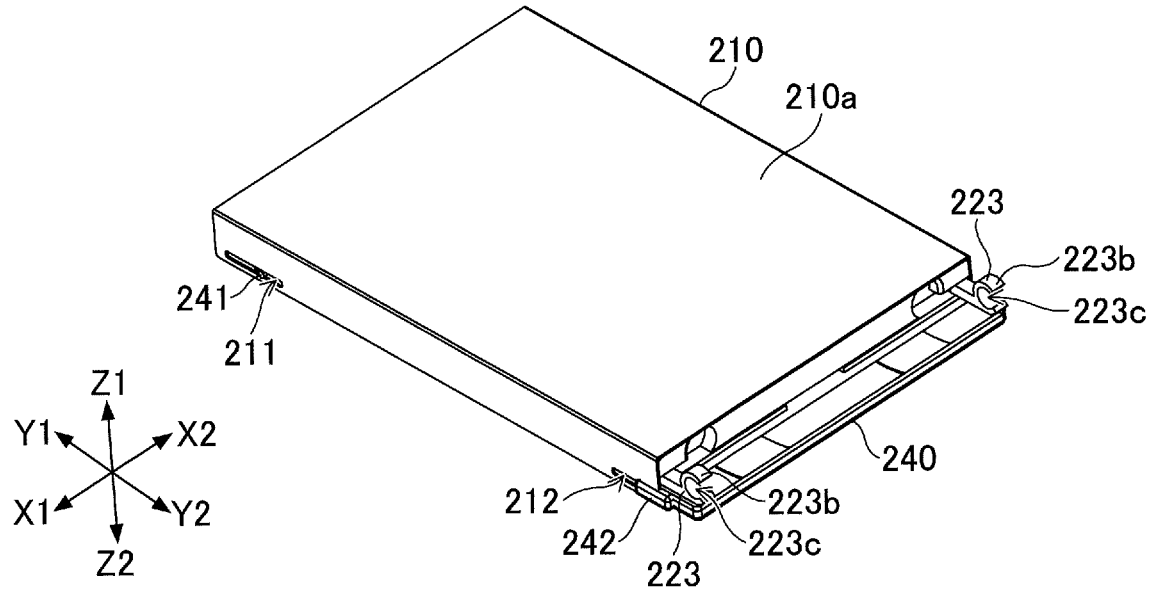
Figure 41:
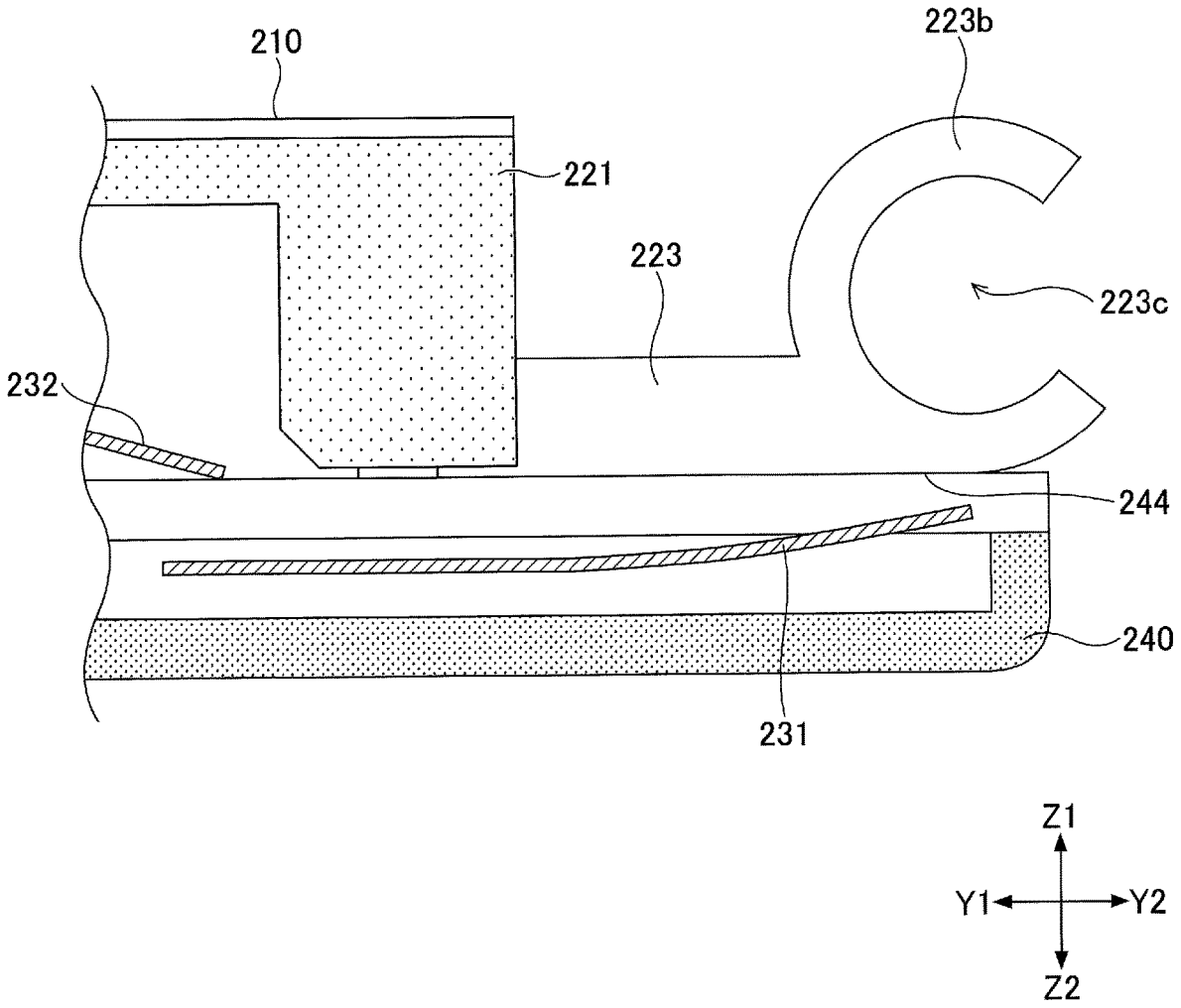

To connect the cassette 200 to the printer 10, first, the lid 240 is slid in the Y2 direction relative to the cover 210 from a position illustrated in FIG. 26, as illustrated in FIG. 39. Next, as illustrated in FIG. 40, the claws 223 are pulled out on the Y2 side. The claws 223 are attached to the case 221 in such a manner as to be pivotable about their respective shafts 223*a* extending in the Z direction. Therefore, by pivoting the claws 223, the claws 223 can be pulled out. FIG. 41 is an enlarged partial view of the cassette 200 with the claws 223 pulled out. If a strong force is applied to the pulled-out claws 223, the claws 223 may break or disengage from the case 221. Therefore, surfaces 244 of the lid 240 support the lower surfaces of the claws 223 to prevent breakage of the claws 223.

Figure 42:
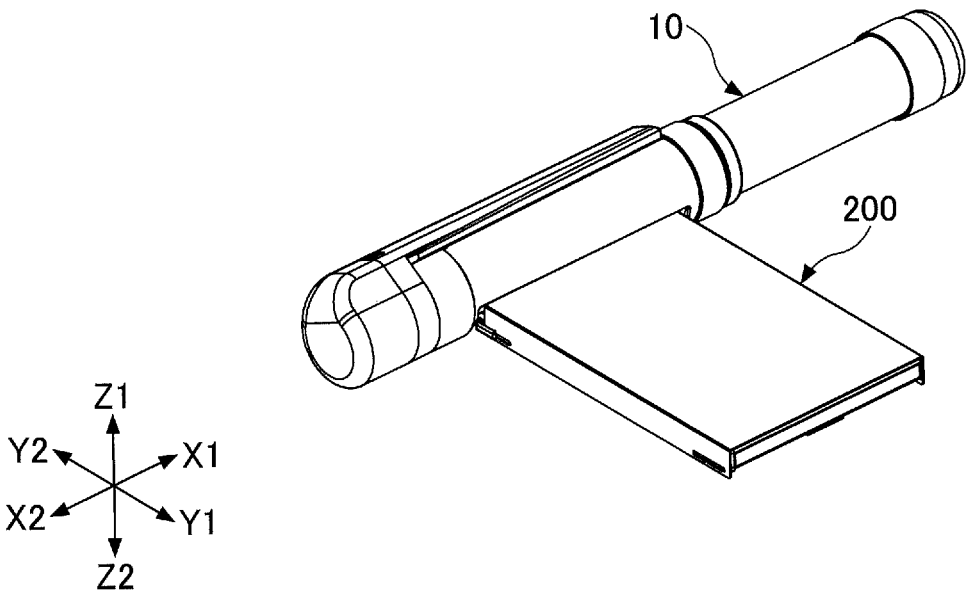

The claws 223 include respective C-shaped clips 223*b*. The cassette 200 can be attached to the printer 10 by placing the shaft of the feed roller 13 into openings 223*c* of the clips 223*b*. FIG. 42 is a perspective view of the printer 10 and the cassette 200 attached to the printer 10.

Figure 43:
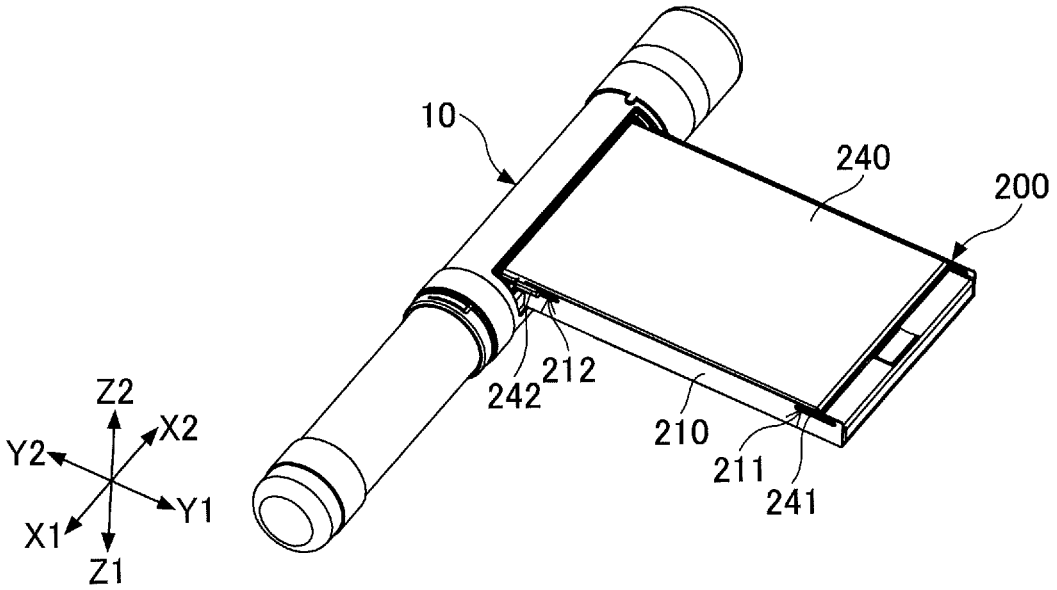
FIGS. 43, 44, 45, 46, 47 and 48 are diagrams illustrating placement of a recording sheet according to the second embodiment.
Figure 44:
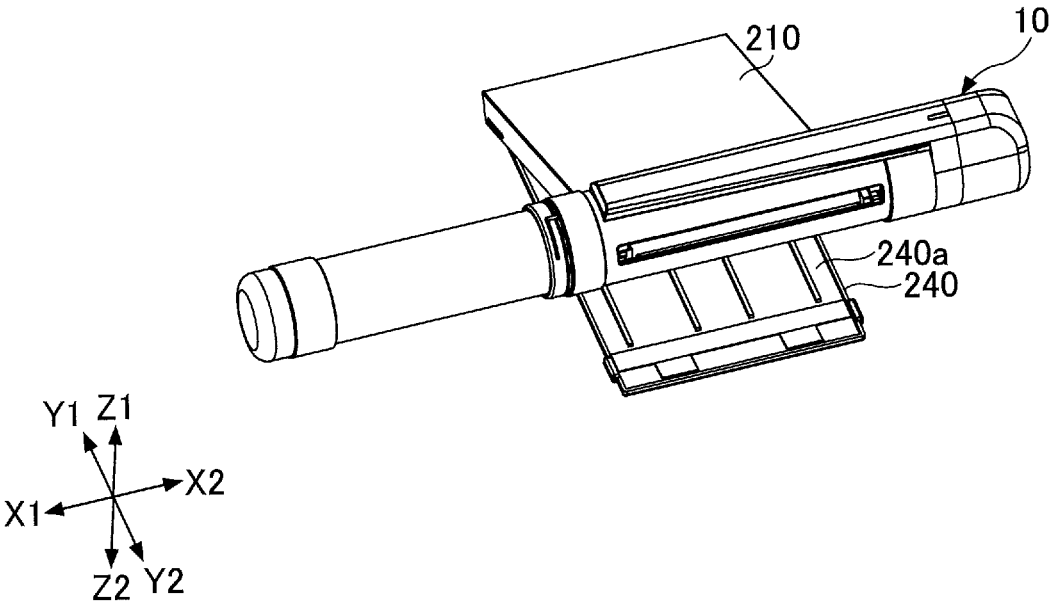

A recording sheet is fed with the cassette 200. With the cassette 200 connected to the printer 10 as illustrated in FIG. 43, the lid 240 is slid in the Y2 direction relative to the cover 210. As a result, the first protrusions 241 move within the first holes 211, and the second protrusions 242 move within the second holes 212. Because the first holes 211 are closed, the first protrusions 241 do not move outside the first holes 211. In contrast, because the second holes 212 have their respective openings 212*a* at the Y2 end, the second protrusions 242 move outside from the openings 212*a* when the lid 240 is slid in the Y2 direction. In this state, the lid 240 is supported only by the first protrusions 241 inside the first holes 211. Therefore, the lid 240 is pivotable on the first protrusions 241 about the X direction. Accordingly, the lid 240 can be opened as illustrated in FIG. 44.

Figure 45:
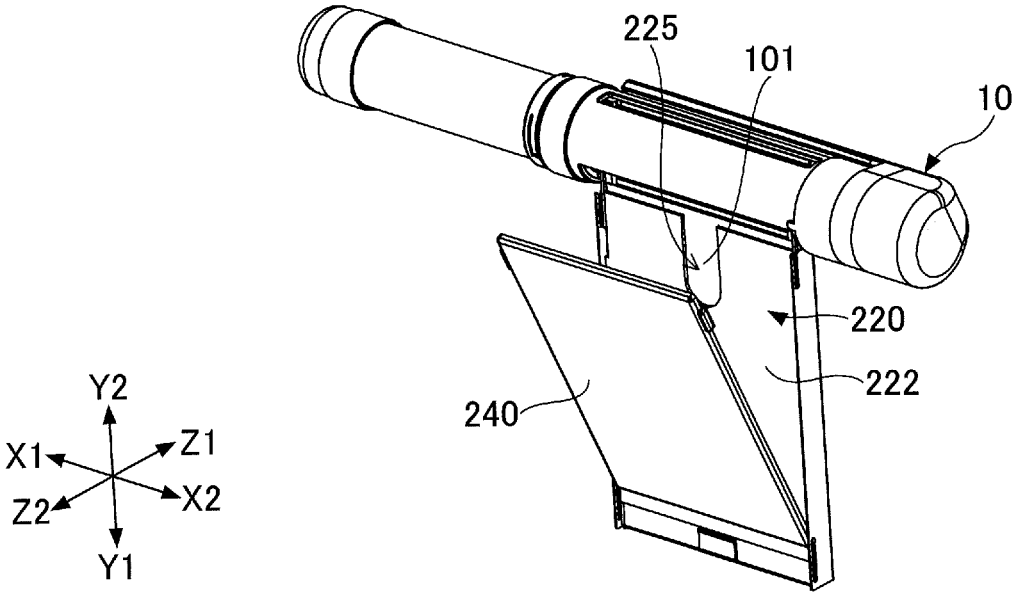
Figure 46:
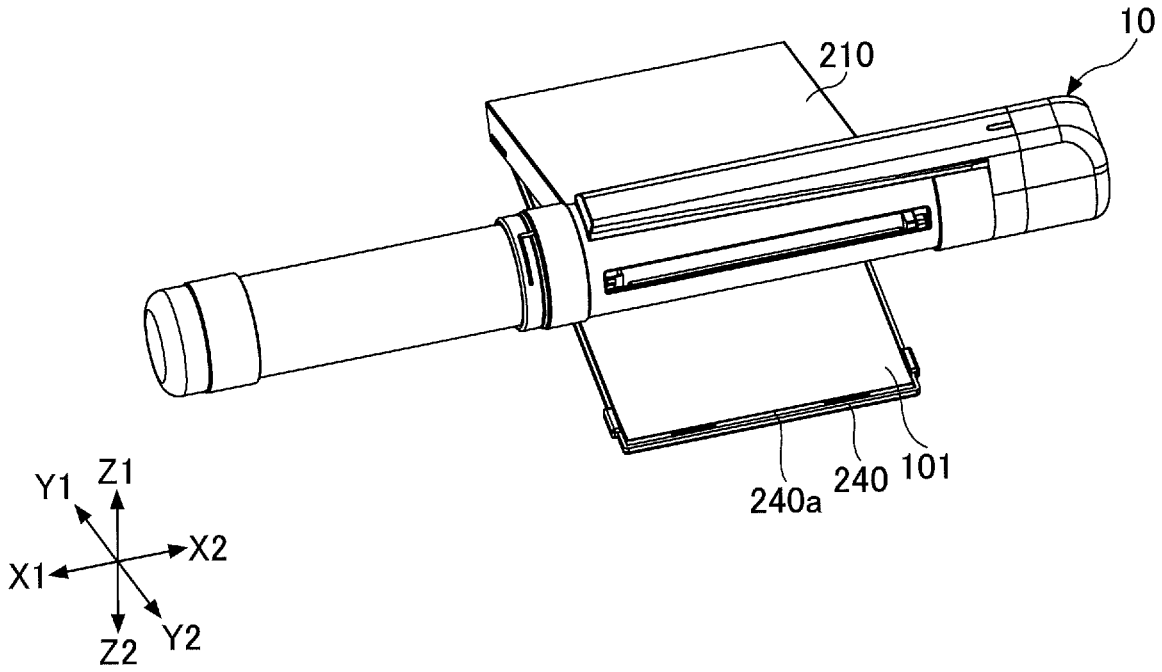

The lid 240 is opened to expose the inner lid 222 as illustrated in FIG. 45, and a finger is placed in the opening 225 to move the topmost recording sheet 101 in the Y2 direction. As a result, one of the recording sheets 101 can be extracted. The extracted recording sheet 101 is placed on the inside surface 240*a* as illustrated in FIG. 46. FIG. 44 illustrates a state before the recording sheet 101 is placed on the surface 240*a*.

Figure 47:
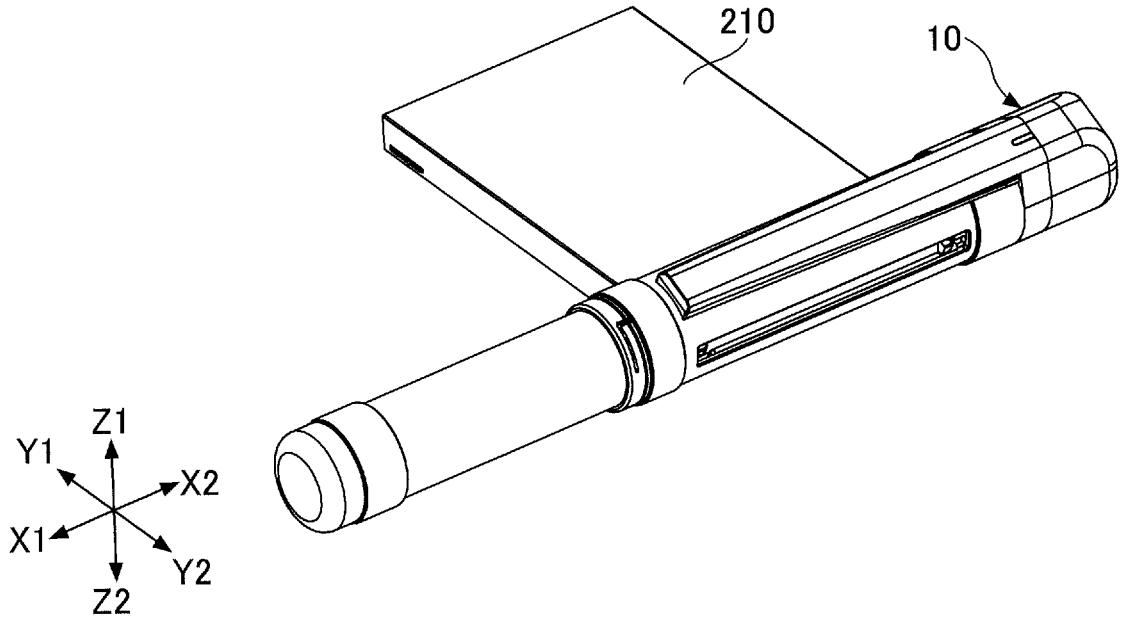
Figure 48:
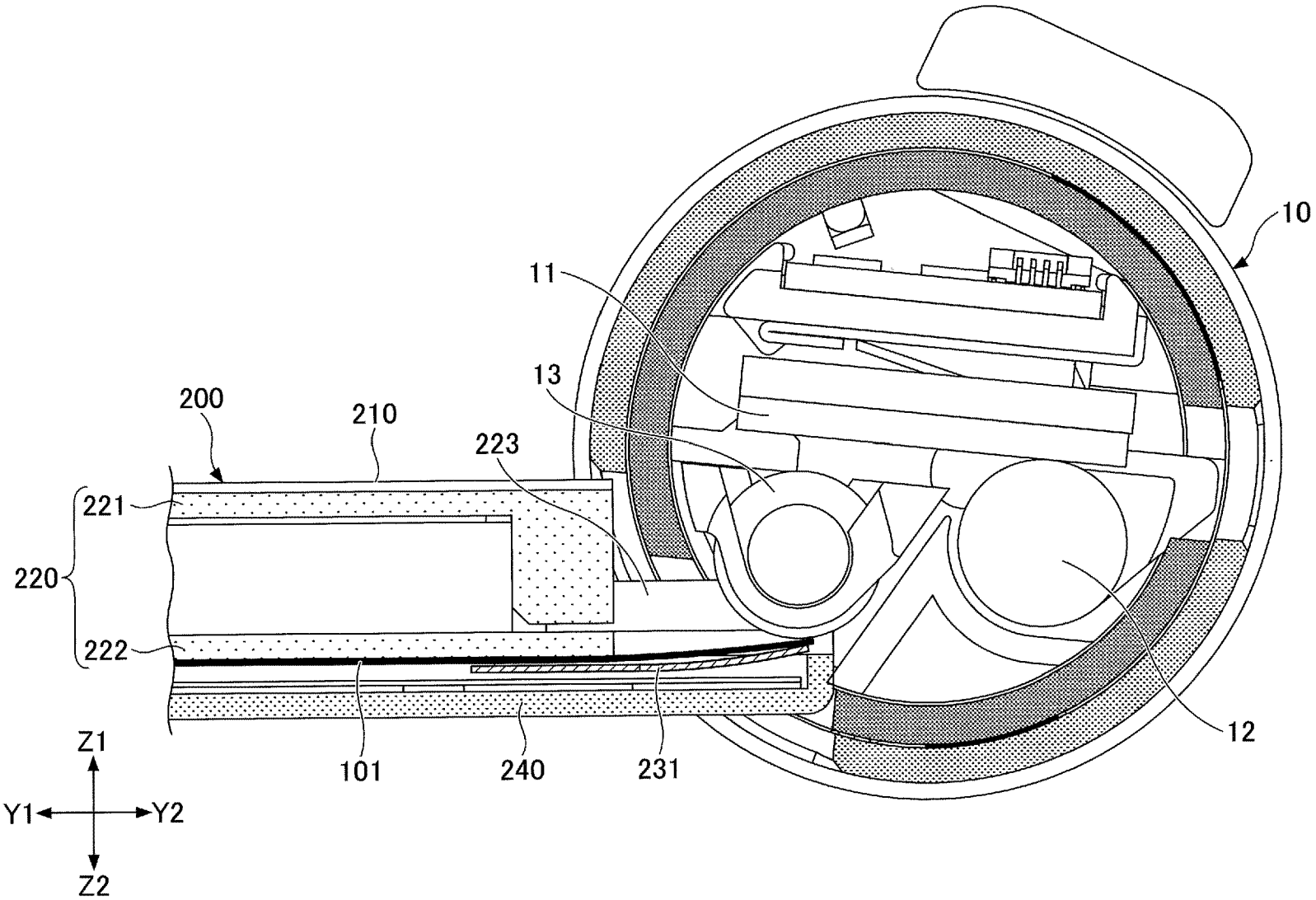

Thereafter, the lid 240 is pivoted on the first protrusions 241 to be closed as illustrated in FIG. 47. FIG. 48 is a partial sectional view of the cassette 200 and the printer 10 in this state. Although not depicted in FIG. 48, the cassette 200 is connected to the printer 10 with the shaft of the feed roller 13 placed in the openings 223*c*. Furthermore, the recording sheet 101 between the inner lid 222 and the lid 240 is pressed to contact the feed roller 13 by the spring 231.

By starting printing in this state, the feed roller 13 rotates counterclockwise in FIG. 48 to feed the recording sheet 101 to the printer 10, and the platen roller 12 rotates clockwise.

Figure 49:
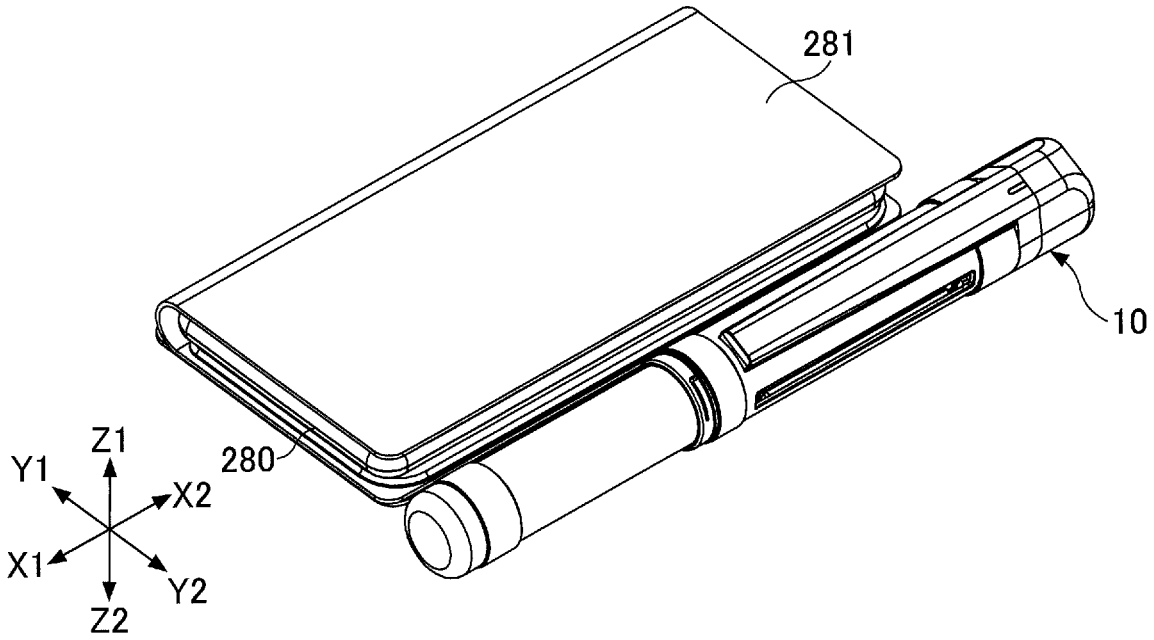
FIGS. 49 and 50 are perspective views of an information terminal and the sheet cassette according to the second embodiment.
Figure 50:
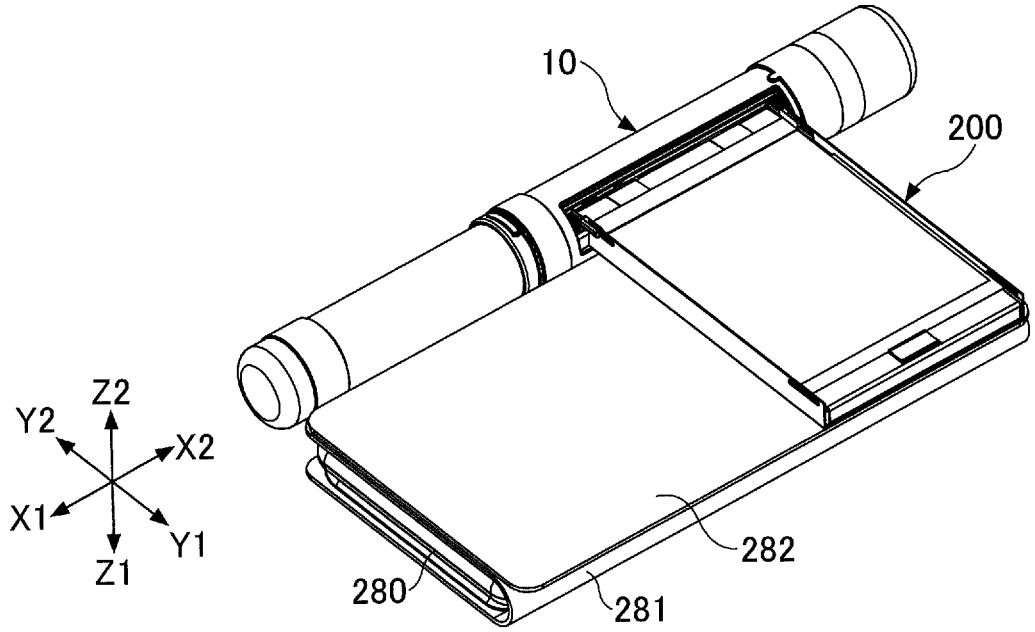

As illustrated in FIGS. 49 and 50, the printer 10 to which the cassette 200 is connected may be attached to an information terminal 280 such as a smartphone. A cover 281 is attached to the terminal 280, and the cassette 200, the cover 281, and a flat plate 282 are connected by an adhesive or the like. The printer 10 can receive information from the terminal 280 through radio communications and perform printing on the recording sheet 101.

In other respects than those described above, the second embodiment may be the same as the first embodiment.

Third Embodiment

A sheet cassette 300 according to a third embodiment is described. FIGS. 51, 52, 53 and 54 are a top perspective view, a top plan view, a front view and a side view, respectively, of the cassette 300.

The cassette 300 includes an outer cover 310 and a case 320. The cover 310 includes a top plate 310*a* and side plates 310*b* that extend in Z2 direction from the X1-side edge and the X2-side edge, respectively, of the top plate 310*a*.

The case 320 includes an inner case 321 and an inner lid 322. The case 320 is covered with the cover 310 on the Z1 side. The recording sheets 101 can be stored in a space surrounded by the case 321 and the inner lid 322.

Figure 55:
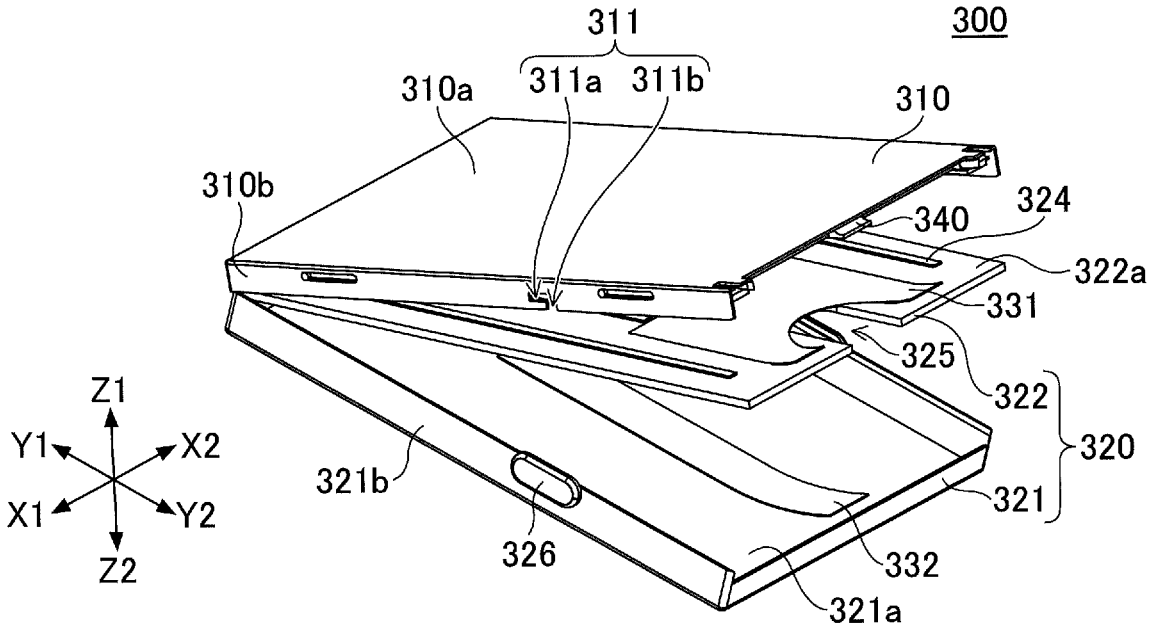
FIG. 55 is a diagram illustrating the sheet cassette according to a third embodiment.

Referring to FIG. 55, an upper lid 340 accommodating claws 323 that connect the cassette 300 to the printer 10 is attached to the inside of the cover 310. A cut for avoiding interference with the feed roller 13 and its shaft is formed at the Y2 end of the cassette 300. The upper lid 340, the inner lid 322, and the case 321 are connected at the Y1 end of the cassette 300 in such a manner as to be pivotable about the X direction.

L-shaped grooves 311 are provided one in each side plate 310*b*. The grooves 311 each have a horizontal groove 311*a* elongated in the Y direction and a vertical groove 311*b* extending in the Z2 direction from the horizontal groove 311*a*. The vertical groove 311*b* is open at its Z2 end.

A spring 331 is provided on a surface 322*a* of the plate-shaped inner lid 322. The spring 331 exerts an urging force in the Z1 direction with the cover 310 and the inner lid 322 closed. The recording sheet 101 placed on the surface 322*a* is pressed toward the printer 10 by the spring 331.

Ribs 324 elongated in the Y direction are provided on the surface 322*a*. The ribs 324 protrude from the surface 322*a* to reduce the contact area between the recording sheet 101 and the inner lid 322. Therefore, it is possible to reduce the friction between the recording sheet 101 and the inner lid 322 when feeding the recording sheet 101. An opening 325 for inserting a finger to take out the recording sheets 101 is provided at the Y2 end of the inner lid 322.

A spring 332 is provided on a surface 321*a* of the case 321 that faces the inner lid 322. The spring 332 presses the recording sheets 101 in the case 320 in the Z1 direction to make it easy to take out the recording sheets 101.

Figure 57:
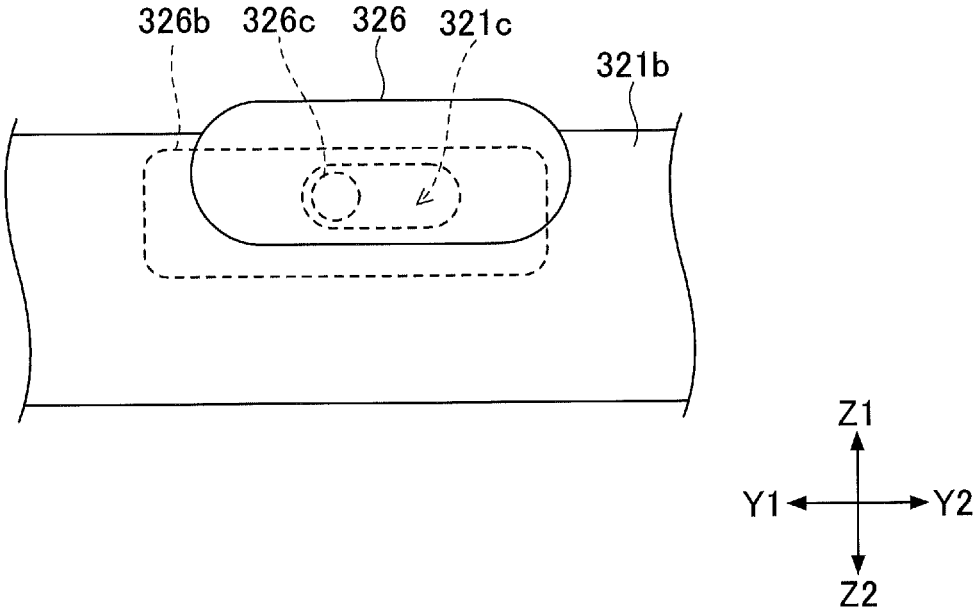
FIGS. 57 and 58 are diagrams illustrating sliders of the sheet cassette according to the third embodiment.
Figure 58:
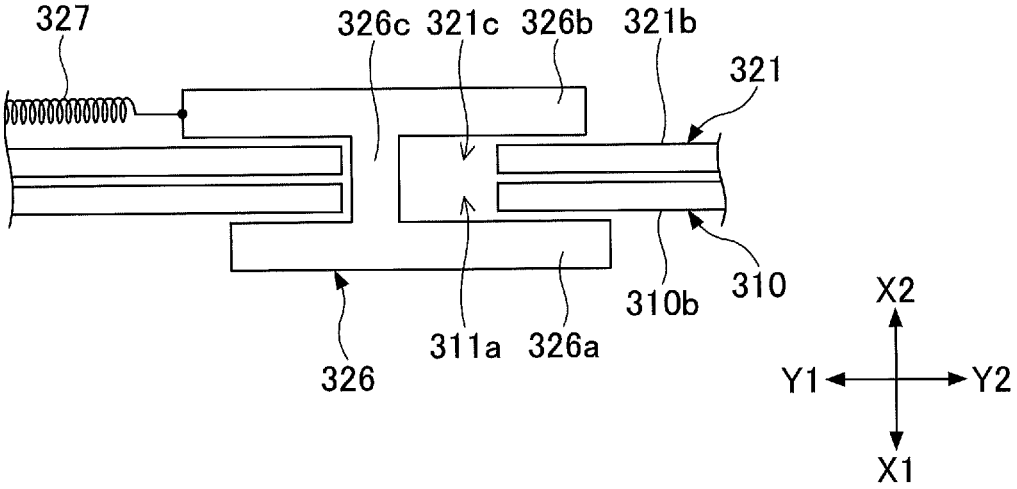

Sliders 326 slidable in the Y direction are provided one on each of side surfaces 321*b* of the case 321. The sliders 326 enter the grooves 311. Referring to FIGS. 57 and 58, the sliders 326 each include an outside part 326*a*, an inside part 326*b*, and a cylindrical connecting part 326*c* connecting the outside part 326*a* and the inside part 326*b*. The outside part 326*a* and the inside part 326*b* are positioned outside and inside each side surface 321*b*, respectively. The sliders 326 are attached to the side surfaces 321*b* with their respective connecting parts 326*c* placed in corresponding elongate holes 321*c* formed one in each side surface 321*b*.

The sliders 326 are urged in the Y1 direction by springs 327. With the cover 310 closed, the sliders 326 are moved in the Y1 direction by the springs 327, and the connecting parts 326*c* are in the horizontal grooves 311*a*. Therefore, the cover 310 is kept closed by the sliders 326.

Figure 68:
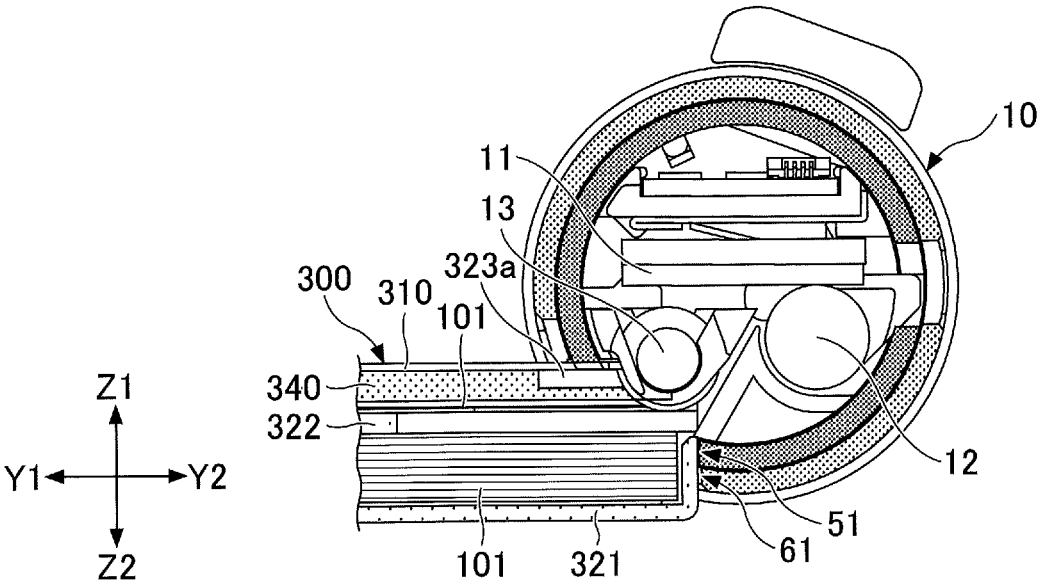

To open the cassette 300, the sliders 326 are moved in the Y2 direction. In FIG. 68, the connecting parts 326*c* are in the horizontal grooves 311*a* to keep the cover 310 closed. Furthermore, the Y2 end face of the case 321 is in contact with walls of the printer 10 at the openings 51 and 61.

By moving the sliders 326 further in the Y2 direction, the connecting parts 326*c* move to the Z1 ends of the vertical grooves 311*b*. By pulling the cover 310 in the Z2 direction, the connecting parts 326*c* move in the vertical grooves 311*b* to allow the cover 310 to open. This two-staged operation prevents the sliders 326 from inadvertently sliding and opening the cover 310.

Figure 56:
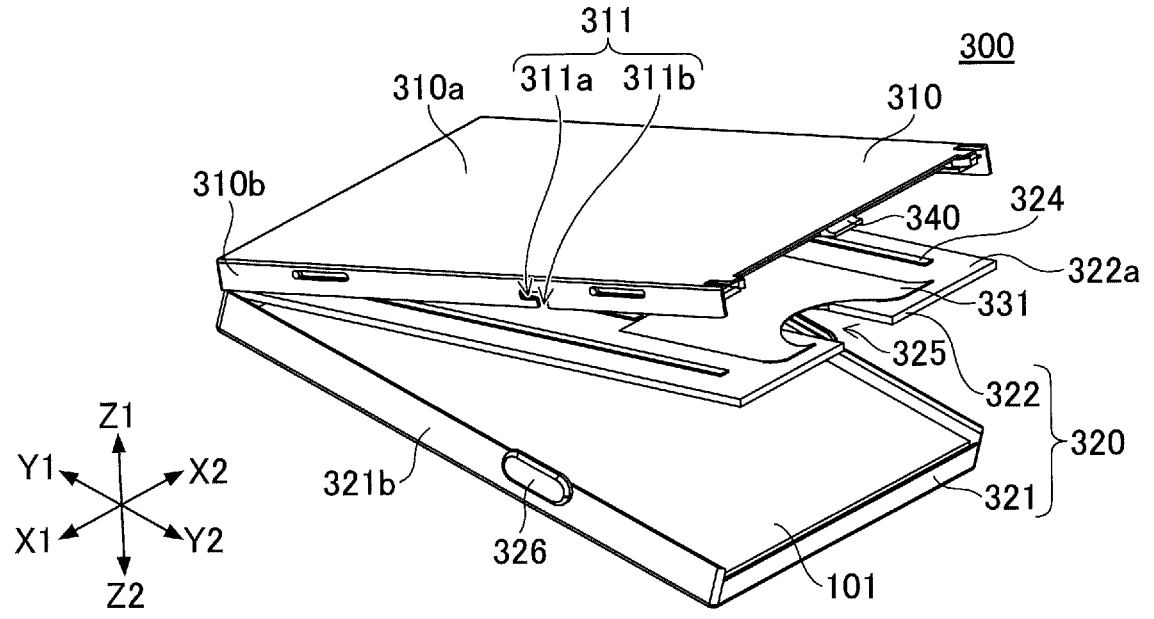
FIG. 56 is a diagram illustrating a method of supplying the sheet cassette with recording sheets according to the third embodiment.
Figure 59:
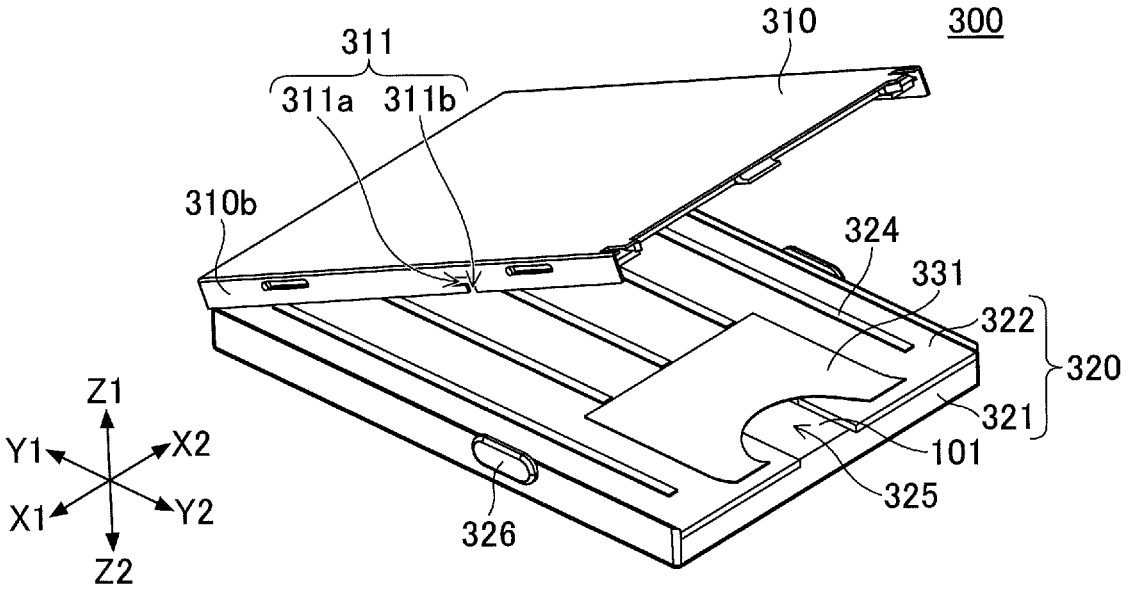
FIGS. 59, 60, 61 and 62 are diagrams illustrating placement of a recording sheet according to the third embodiment.

To supply the cassette 300 with the recording sheets 101, the case 321 and the inner lid 322 are opened as illustrated in FIG. 55, and the recording sheets 101 are placed into the case 321 as illustrated in FIG. 56. Thereafter, by pivoting the inner lid 322 toward the case 321 as illustrated in FIG. 59, the recording sheets 101 are stored in the case 320. Thereafter, the cover 310 is closed as illustrated in FIG. 51.

Figure 51:
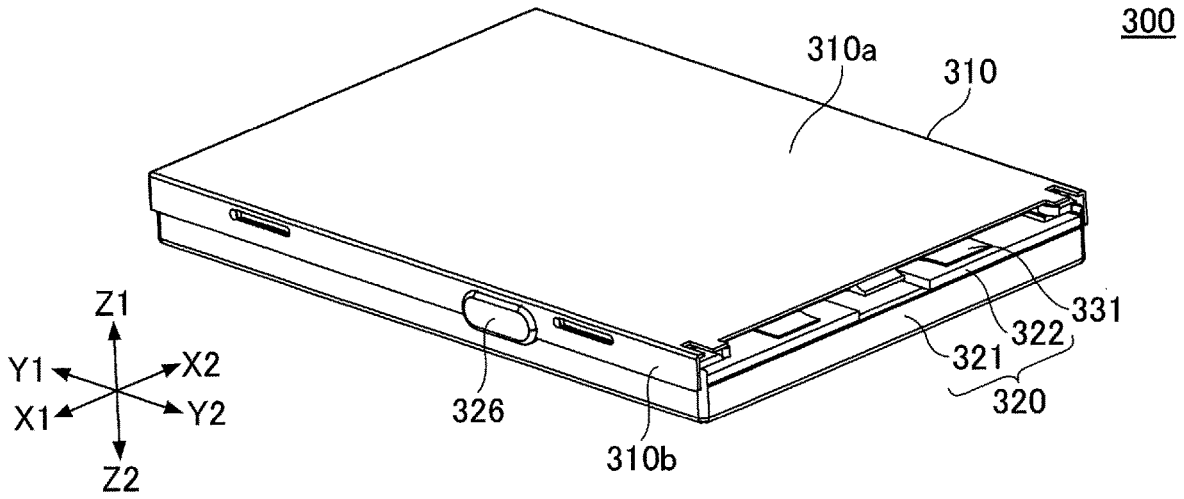
FIGS. 51, 52, 53 and 54 are a top perspective view, a top plan view, a front view and a side view, respectively, of a sheet cassette according to a third embodiment.
Figure 52:
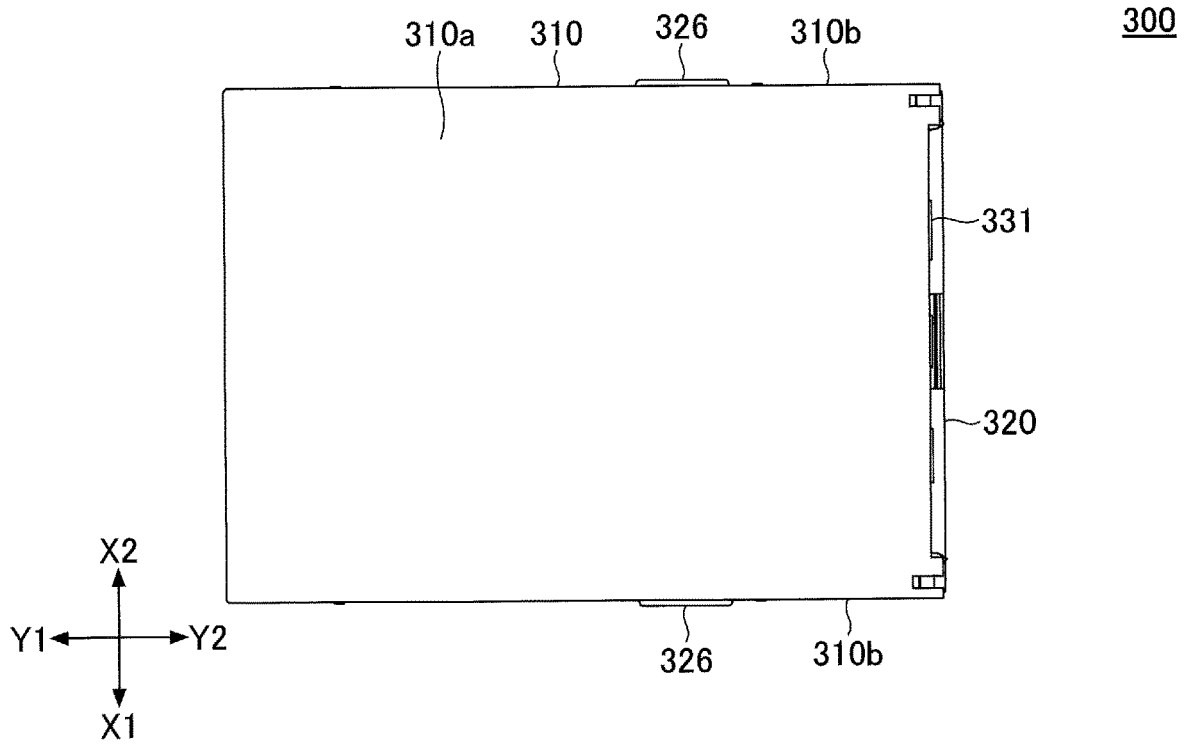
Figure 53:
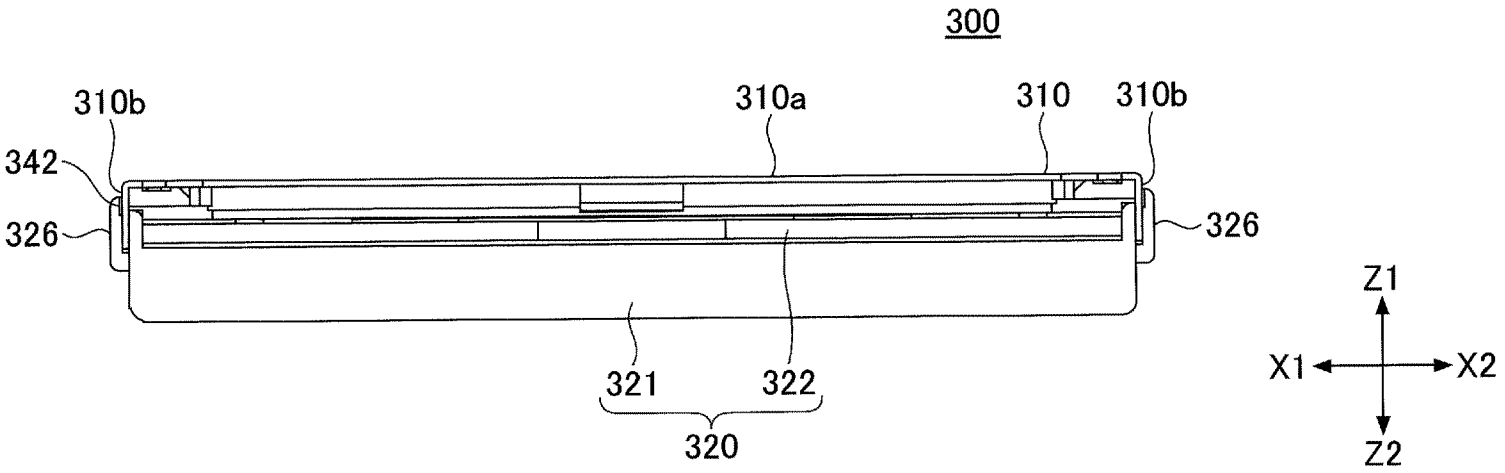
Figure 54:
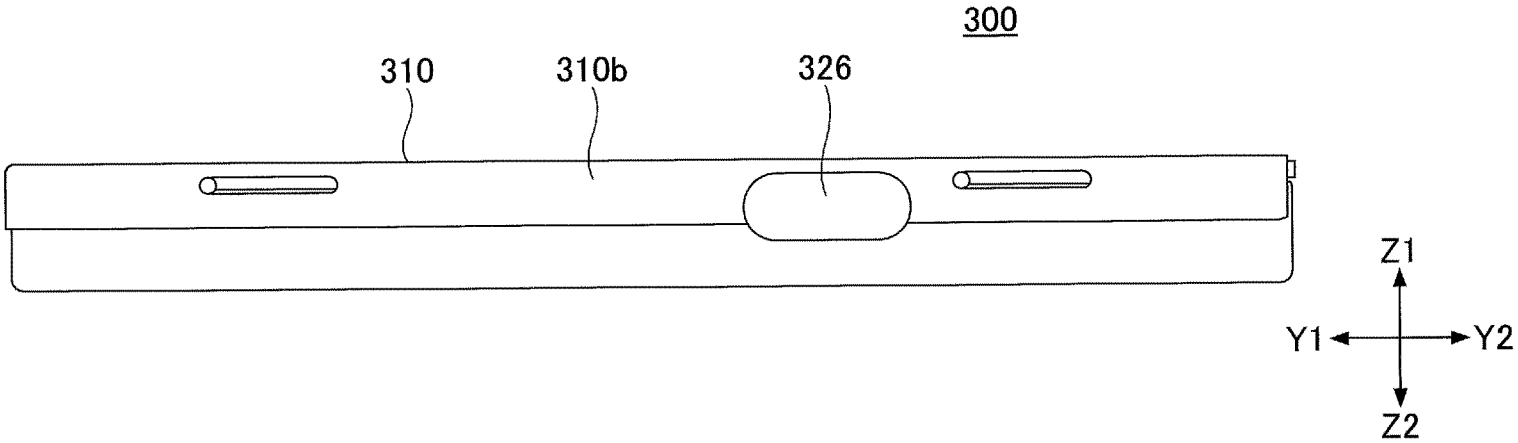
Figure 60:
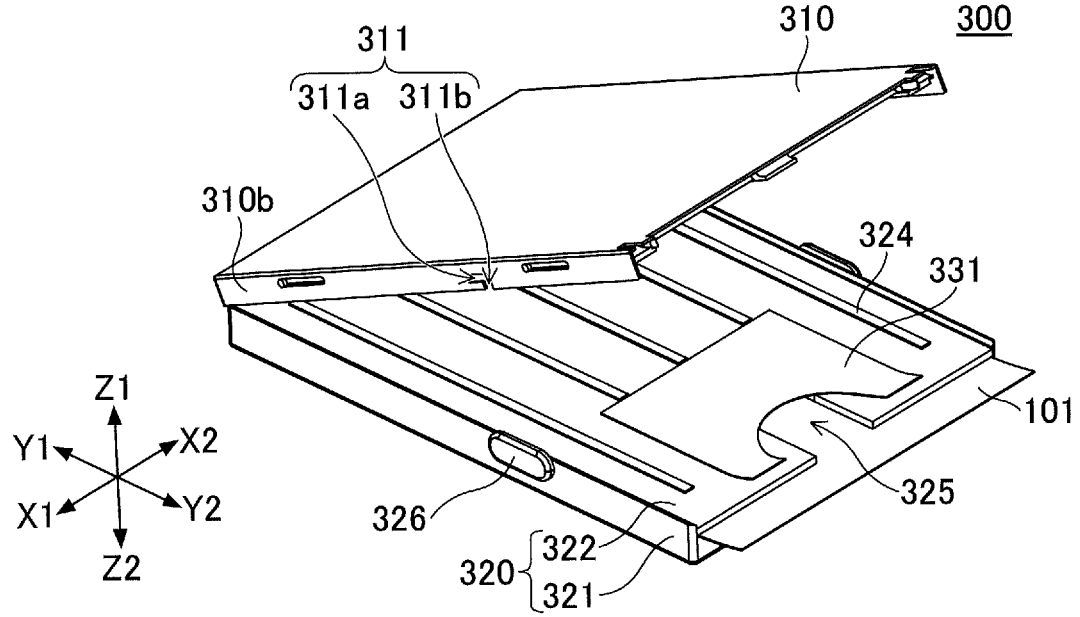

To extract the recording sheet 101 in the case 320, the case 320 is pivoted from the position illustrated in FIG. 51 to expose the inner lid 322 as illustrated in FIG. 59. In this state, by placing a finger in the opening 325 to move the topmost recording sheet 101 in the Y2 direction, a single recording sheet 101 can be extracted from the case 320 as illustrated in FIG. 60.

Figure 61:
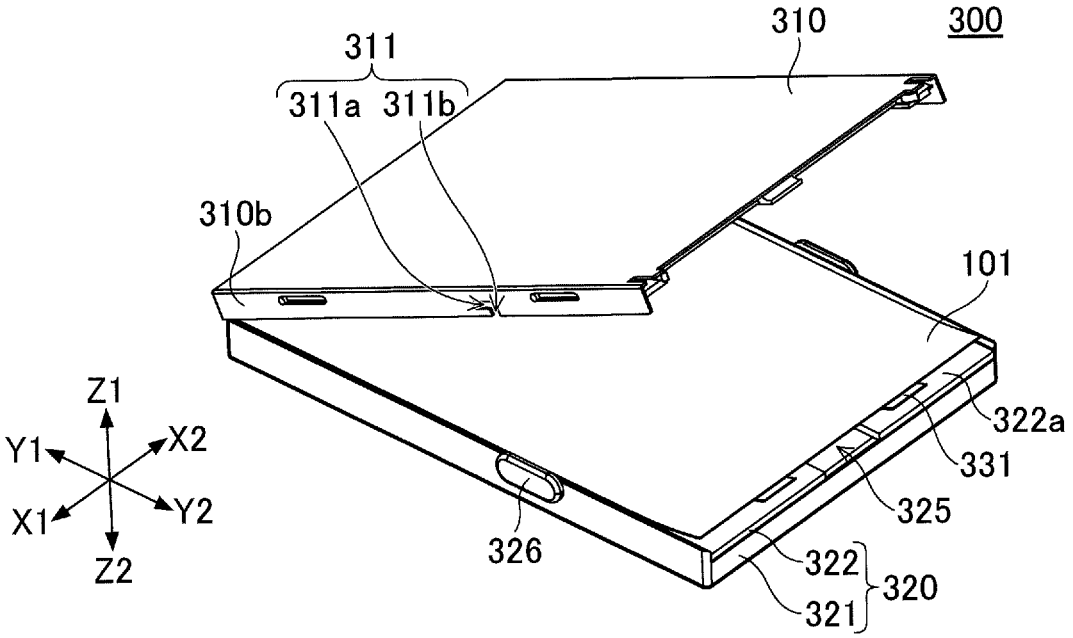
Figure 62:
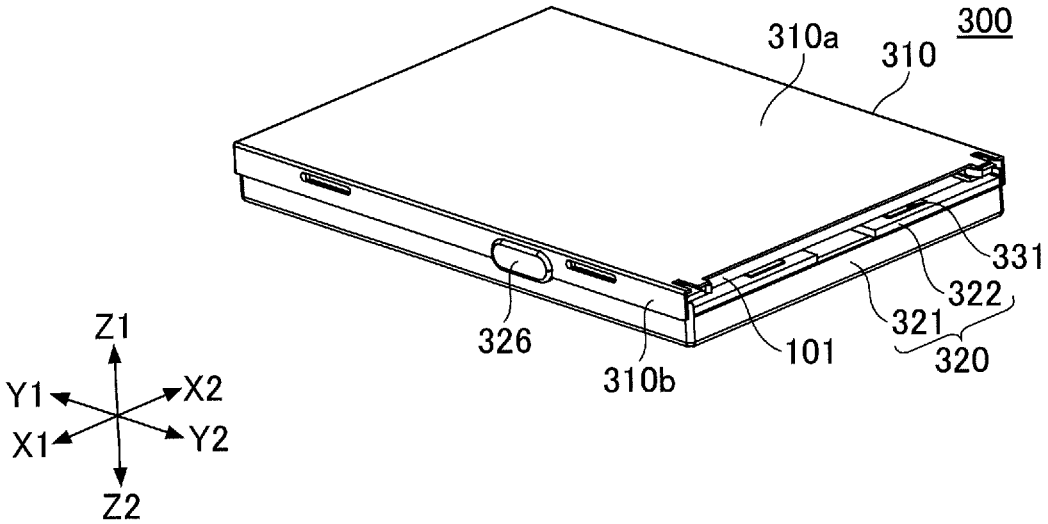

The extracted recording sheet 101 is placed on the surface 322*a* as illustrated in FIG. 61. Thereafter, the cover 310 is closed as illustrated in FIG. 62. In this state, the recording sheet 101 placed on the inner lid 322 is between the cover 310 and the case 320. At this point, the connecting parts 326*c* are in the grooves 311.

Figure 63:
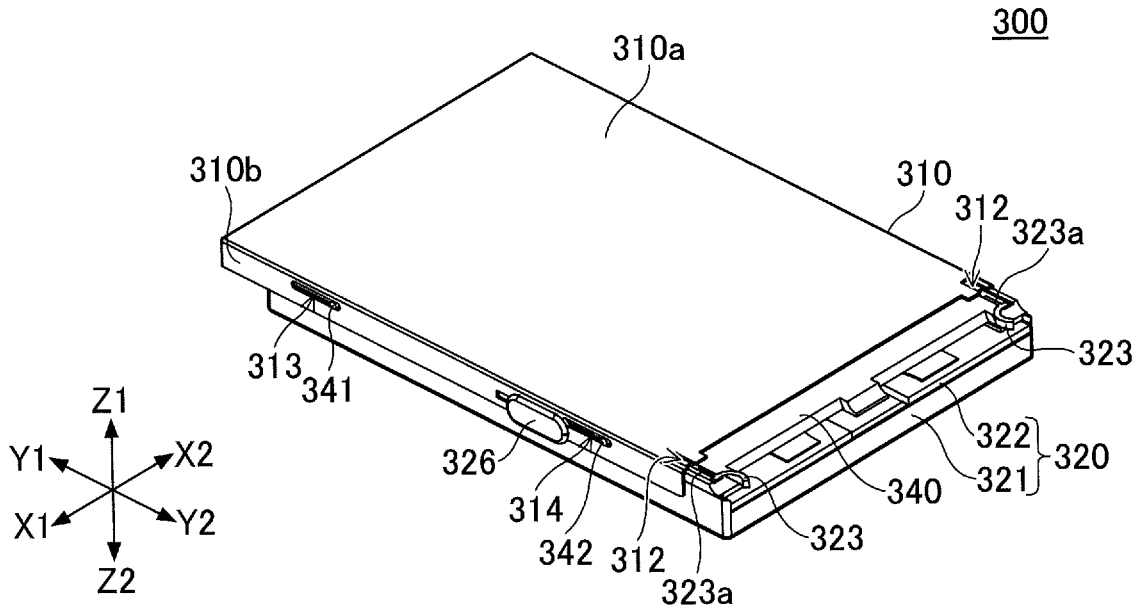
FIGS. 63, 64, 65, 66, 67 and 68 are diagrams illustrating connection of the sheet cassette to the printer according to the third embodiment.

To connect the cassette 300 to the printer 10, the cover 310 is slid in the Y1 direction from a position illustrated in FIG. 51 to a position illustrated in FIG. 63. The upper lid 340 is provided on the side of the cover 310 facing the inner lid 322.

Each side plate 310*b* includes a first hole 313 near the Y1 end and a second hole 314 near the Y2 end, each of which is elongated in the Y direction and closed. Each of the side surfaces of the upper lid 340 includes a first protrusion 341 near the Y1 end and a second protrusion 342 near the Y2 end.

The cover 310 and the upper lid 340 are connected with the first protrusions 341 entering the first holes 313 and the second protrusions 342 entering the second holes 314. The first protrusions 341 are freely movable within the first holes 313, and the second protrusions 342 are freely movable within the second holes 314. As a result, the cover 310 can slide in the Y direction.

The claws 323 are provided one on each side of the upper lid 340 at the Y2 end of the upper lid 340. By sliding the cover 310 in the Y1 direction, the upper lid 340 is partly exposed to expose the claws 323 lying parallel to the XY plane as illustrated in FIG. 63.

Figure 64:
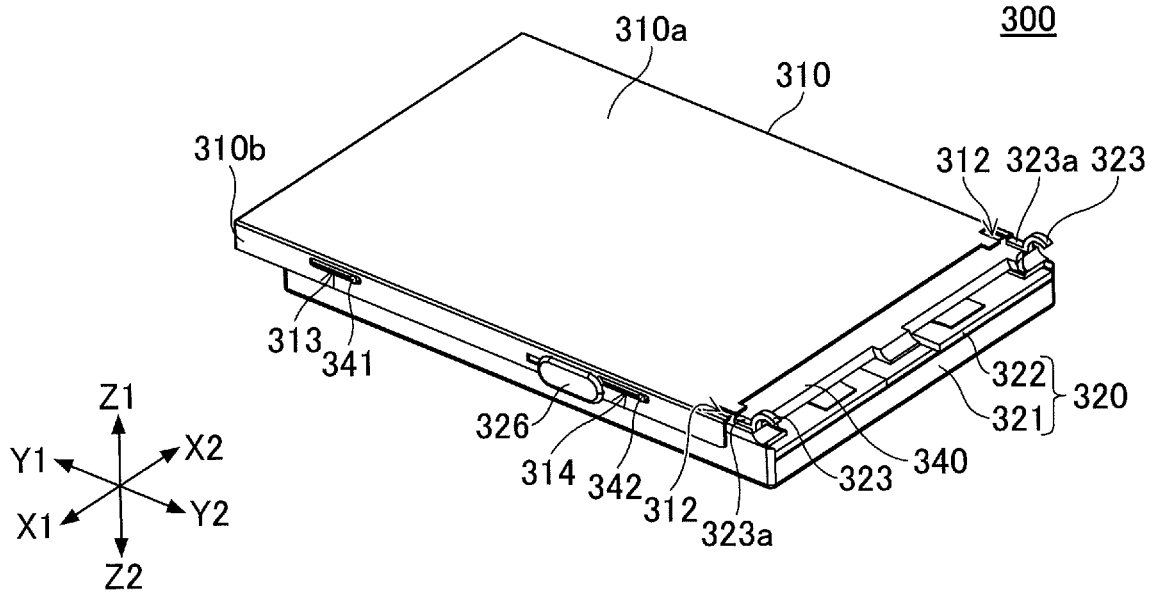
Figure 65:
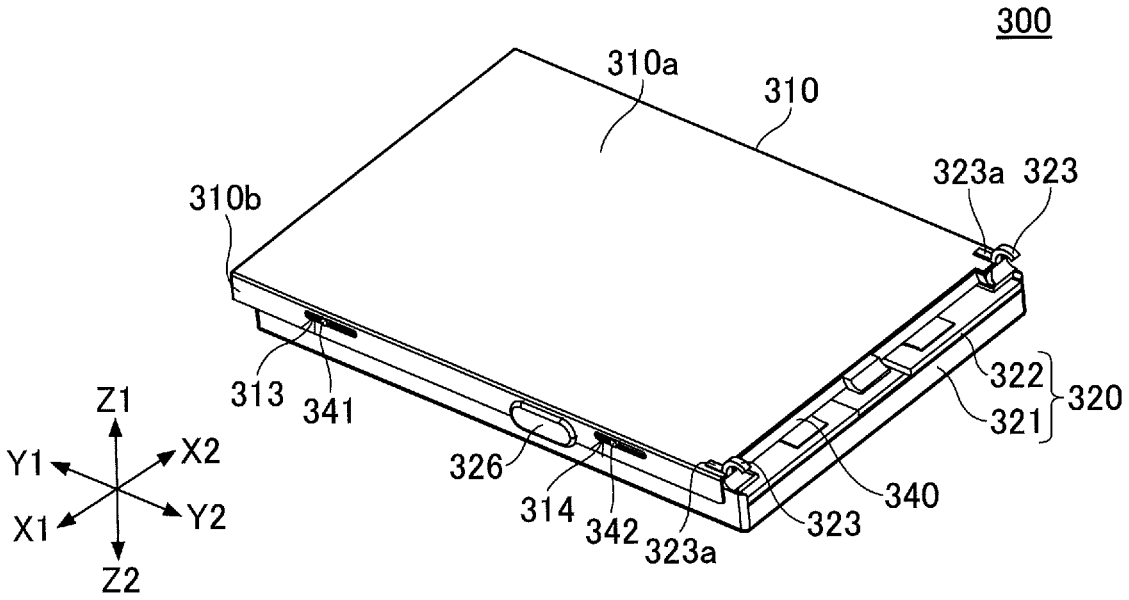
Figure 66:
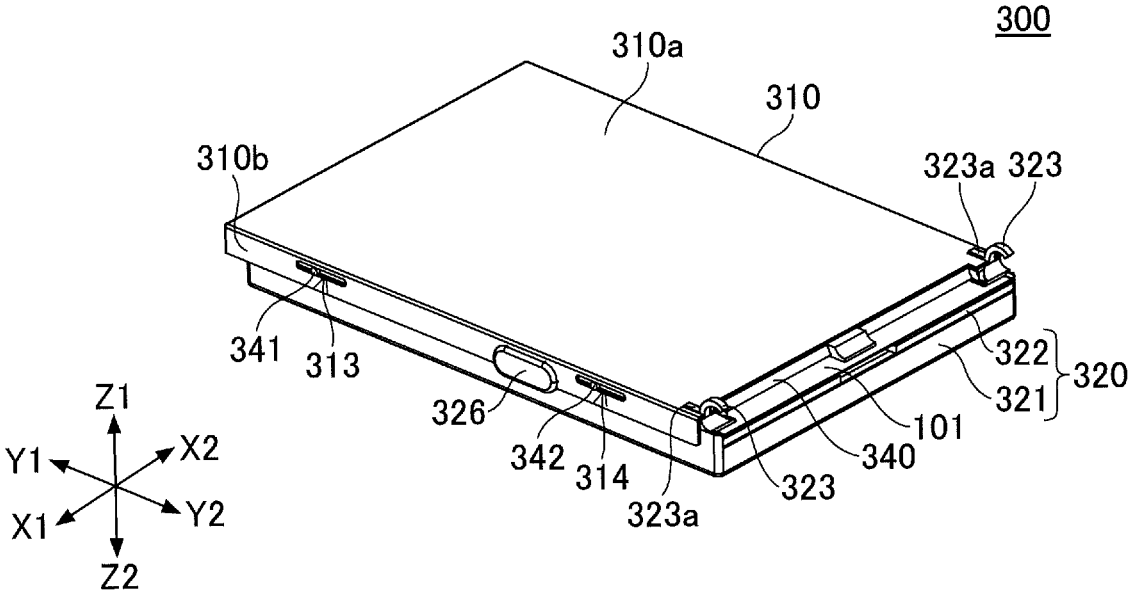

The claws 323 are attached to the upper lid 340 in such a manner as to be pivotable about the Y direction. By exposing the claws 323 as illustrated in FIG. 63, it is possible to stand the claws 323 in the Z1 direction as illustrated in FIG. 64. Thereafter, the cover 310 is slid in the Y2 direction as illustrated in FIG. 65. The claws 323 include respective supports 323*a* elongated in the Y direction. The top plate 310*a* includes grooves 312 elongated in the Y direction. Accordingly, when the cover 310 is slid in the Y2 direction, the supports 323*a* enter the grooves 312 to be supported by the grooves 312. FIG. 66 illustrates the cassette 300 in which the recording sheet 101 is placed on the surface 322*a*. The claws 323 may be stored back in the upper lid 340 and covered by the cover 310 by performing the above-described operation in reverse order. The portability of the cassette 300 is thus improved.

Figure 67:
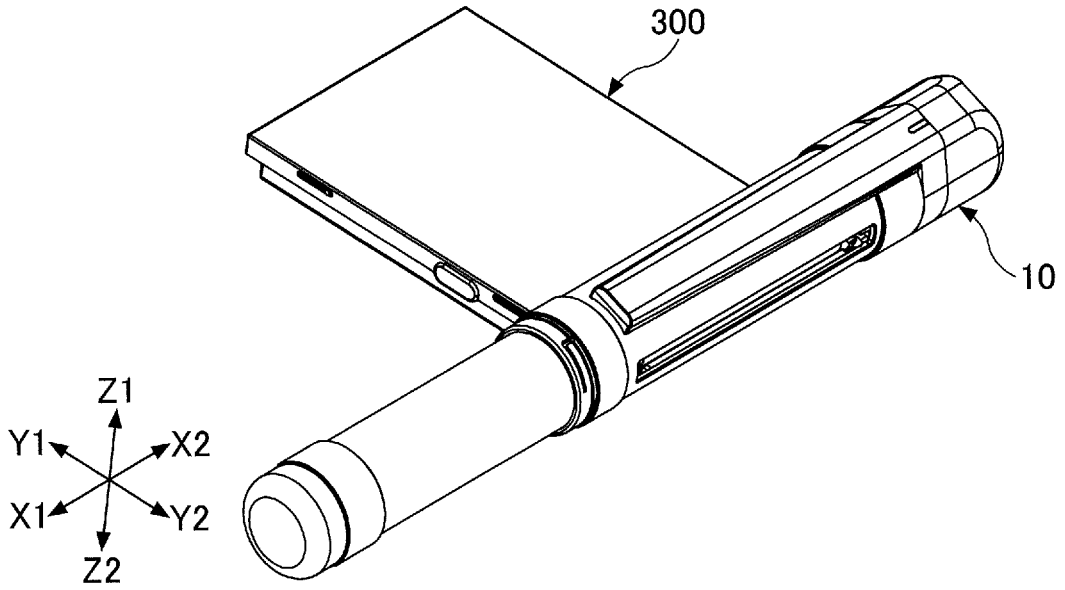

By placing the shaft of the feed roller 13 into the openings of the clip-shaped claws 323, the cassette 300 can be attached to the printer 10 as illustrated in FIGS. 67 and 68. FIG. 67 is a perspective view of the printer 10 to which the cassette 300 is attached. FIG. 68 is a sectional view of the printer 10 and the cassette 300. The claws 323 also serve as sheet guides to guide the recording sheet 101 on both sides.

The recording sheet 101 placed on the surface 322*a* is pressed to contact the feed roller 13 by the spring 331.

By starting printing, the feed roller 13 rotates counter-clockwise in FIG. 68 to feed the recording sheet 101 to the printer 10, and the platen roller 12 rotates clockwise.

Figure 69:
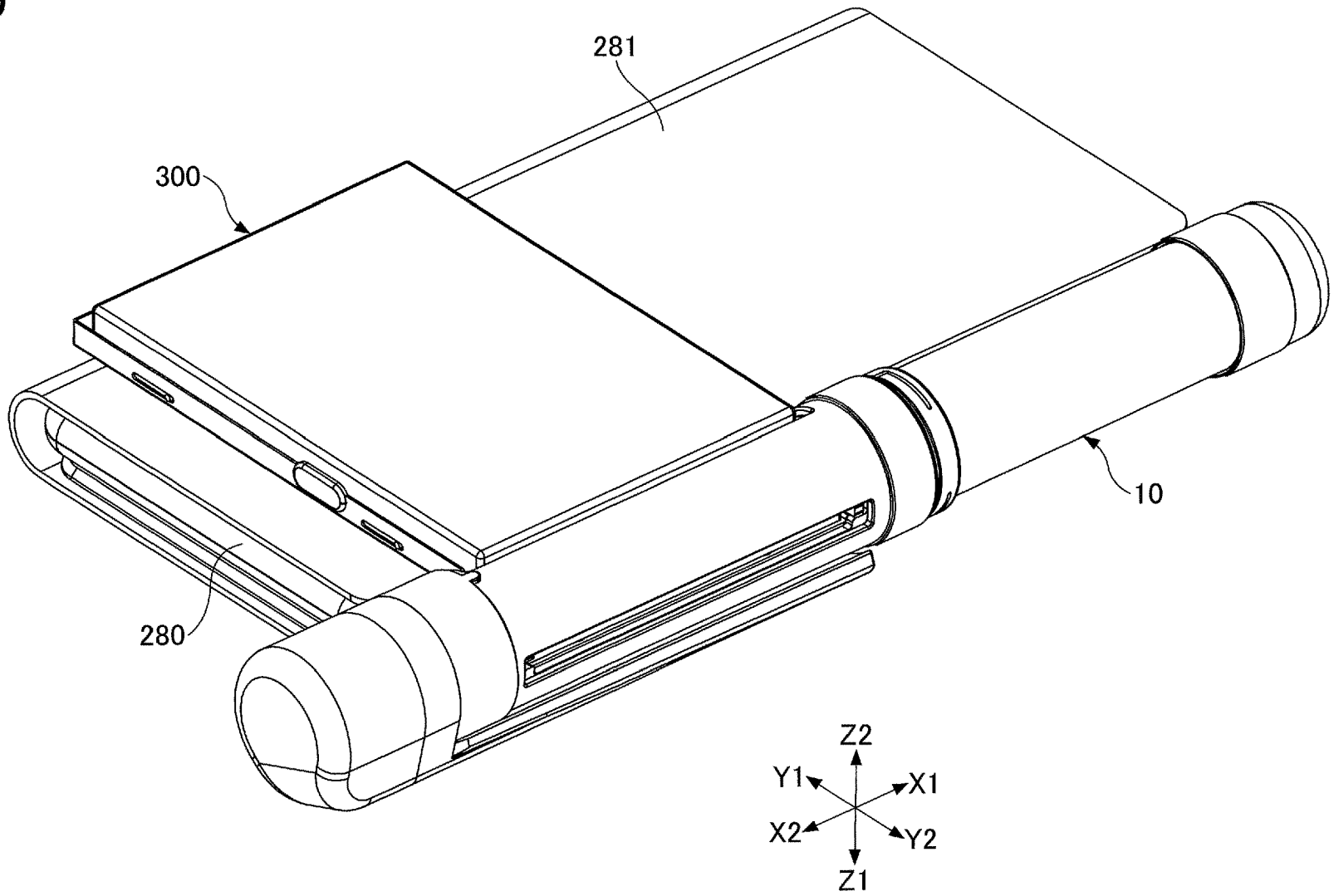
FIG. 69 is a perspective view of the information terminal and the sheet cassette according to the third embodiment.

FIG. 69 is a perspective view of the printer 10 attached to the terminal 280. As illustrated in FIG. 69, the printer 10 to which the cassette 300 is connected may be attached to the terminal 280. The cover 281 attached to the terminal 280 is connected to the cassette 300 by an adhesive or the like. The printer 10 can receive information from the terminal 280 through radio communications and perform printing.

In other respects than those described above, the third embodiment may be the same as the first embodiment.

The present invention is not limited to the specifically disclosed embodiments, and variations and modifications may be made without departing from the scope of the present invention.

What is claimed is:

1. A sheet cassette connectable to a printer, the sheet cassette comprising:

a case configured to store a first recording sheet;

a spring provided on the case;

a cover covering the case and the spring, and configured to slide relative to the case to expose the spring; and a connecting part attached to the case, and configured to be connected to the printer, wherein the spring is provided on an outside surface of the case to directly press a second recording sheet placed on an upper surface of the cover toward a position at which the printer is to be located when the printer is connected to the sheet cassette, when the spring is exposed by sliding the cover.

2. The sheet cassette as claimed in claim 1, further comprising:

an additional spring attached to an inside surface of the case to press the first recording sheet stored in the case away from the inside surface, wherein the case has an opening through which the first recording sheet stored in the case is extracted.

3. The sheet cassette as claimed in claim 1, wherein the connecting part is accommodated in the case, and is exposed when the cover slides relative to the case, and the cover is configured to support the connecting part by being returned to a predetermined position relative to the case after the cover is slid relative to the case and the connecting part is connected to the printer.

4. The sheet cassette as claimed in claim 1, wherein the cover has a hollow structure having a bottom on a first side and an opening on a second side opposite from the first side, and the case is inserted into the cover through the opening.

5. A sheet cassette connectable to a printer, the sheet cassette comprising:

a case configured to store a recording sheet;

a cover covering the case; and a lid pivotably attached to the cover, wherein a side surface of the cover has a first hole and a second hole, the second hole having an open end, a side surface of the lid facing the side surface of the cover includes a first protrusion placed in the first hole and a second protrusion placed in the second hole, and the lid is configured to pivot on the first protrusion when the lid is slid relative to the cover so that the second protrusion is moved out of the second hole through the open end.

6. A sheet cassette connectable to a printer, the sheet cassette comprising:

a case configured to store a first recording sheet;

a cover covering the case;

a lid pivotably attached to the cover;

a spring provided on the lid, the spring being configured to press a second recording sheet between the lid and the case toward a position at which the printer is to be located when the printer is connected to the sheet cassette; and an additional spring attached to an inside surface of the case to press the first recording sheet stored in the case away from the inside surface, wherein the case has an opening through which the first recording sheet stored in the case is extracted.

7. A sheet cassette connectable to a printer, the sheet cassette comprising:

a case configured to store a recording sheet;

a cover covering the case;

a lid provided between the cover and the case;

a connecting part attached to the lid, and configured to be connected to the printer; and a spring provided on a surface of the case facing the lid, the spring being configured to directly press the recording sheet placed on the surface of the case between the case and the lid toward the lid, wherein the cover and the lid are connected in such a manner as to pivot relative to each other about an axis in a first direction at an end of the sheet cassette in a second direction perpendicular to the first direction.

8. The sheet cassette as claimed in claim 7, wherein the connecting part is accommodated in the lid, the cover is configured to slide relative to the lid to expose the connecting part, and the cover is configured to support the connecting part by being returned to a predetermined position relative to the lid after the cover is slid relative to the lid and the connecting part is connected to the printer.

9. The sheet cassette as claimed in claim 7, wherein the connecting part is exposed when the cover is slid in a first direction, and is supported by the cover to be connectable to the printer when the cover is slid back in a second direction opposite to the first direction after the connecting part is pivoted in a third direction, and when storing the connecting part supported by the cover, the connecting part is pivoted in a fourth direction opposite to the third direction to be accommodated in the lid after the cover is slid in the first direction, and the cover is slid back in the second direction to cover the connecting part accommodated in the lid.

10. The sheet cassette as claimed in claim 7, further comprising:

an additional spring provided on the lid and facing the cover, the additional spring being configured to press an additional recording sheet placed between the lid and the cover toward a position at which the printer is to be located when the printer is connected to the sheet cassette.

* * * * *